US006132036A

United States Patent [19]

Abe et al.

[11] Patent Number: 6,132,036

[45] Date of Patent: Oct. 17, 2000

[54] INK TANK, PRODUCTION PROCESS OF INK TANK AND INK-JET PRINTING APPARATUS

[75] Inventors: Tsutomu Abe, Isehara; Yutaka Koizumi, Yokohama; Kiyomi Aono, Kawasaki; Seiichiro Karita, Yokohama; Kouichi Omata, Kawasaki; Hiroki Tajima, Machida, all of Japan

[73] Assignee: Canon Kabushiki Kaisha, Tokyo, Japan

[21] Appl. No.: 08/711,948

[22] Filed: Sep. 6, 1996

[30] Foreign Application Priority Data

| | | | |
|---|---|---|---|
| Sep. 14, 1995 | [JP] | Japan | 7-237461 |
| Sep. 14, 1995 | [JP] | Japan | 7-237462 |
| Oct. 13, 1995 | [JP] | Japan | 7-266040 |

[51] Int. Cl.[7] ..... B41J 2/175

[52] U.S. Cl. ..... 347/86

[58] Field of Search ..... 347/85, 86, 87; 277/635

[56] References Cited

U.S. PATENT DOCUMENTS

| | | | |
|---|---|---|---|
| 4,180,173 | 12/1979 | Diaz | 215/6 |
| 4,695,824 | 9/1987 | Tazaki | 347/86 |
| 5,126,767 | 6/1992 | Asai | 347/86 |
| 5,155,502 | 10/1992 | Kimura et al. | 347/87 |
| 5,156,472 | 10/1992 | Suzuki et al. | 400/124.1 |
| 5,221,935 | 6/1993 | Uzita | 347/36 |
| 5,270,739 | 12/1993 | Kitani et al. | 347/87 |
| 5,365,260 | 11/1994 | Kitani et al. | 347/87 |
| 5,400,573 | 3/1995 | Crystal et al. | 53/468 |
| 5,405,001 | 4/1995 | Lillard | 206/221 |
| 5,444,473 | 8/1995 | Hattori et al. | 347/87 |
| 5,453,772 | 9/1995 | Aono et al. | 347/87 |
| 5,500,664 | 3/1996 | Suzuki et al. | 347/86 |
| 5,502,479 | 3/1996 | Ishinaga et al. | 347/93 |
| 5,509,140 | 4/1996 | Koitabashi et al. | 347/86 |

FOREIGN PATENT DOCUMENTS

| | | | |
|---|---|---|---|
| 0 546 832 | 6/1993 | European Pat. Off. | B41J 2/175 |
| 553535 | 8/1993 | European Pat. Off. . | |
| 0559206 | 9/1993 | European Pat. Off. . | |
| 0 635 373 | 1/1995 | European Pat. Off. | B41J 2/175 |
| 631874 | 1/1995 | European Pat. Off. . | |
| 43 44 746 A1 | 6/1995 | European Pat. Off. . | |
| 3316969 | 11/1983 | Germany . | |
| 3220620 | 12/1983 | Germany . | |
| 61-054942 | 3/1986 | Japan . | |
| 2-020350 | 1/1990 | Japan . | |
| 6-000963 | 1/1994 | Japan . | |
| 8805411 | 7/1988 | WIPO . | |
| WO 91/04156 | 4/1991 | WIPO . | |
| 94/03373 | 2/1994 | WIPO | B65D 51/00 |

*Primary Examiner*—N. Le
*Assistant Examiner*—Michael Nghiem
*Attorney, Agent, or Firm*—Fitzpatrick, Cella, Harper & Scinto

[57] ABSTRACT

An ink tank has an ink container storing the ink to be used in the printing apparatus, a waste ink container storing the ink used in the printing apparatus, an atmosphere communication hole provided in the waste ink container, and a coupling member provided on one of or both of the ink container and the waste ink container and provided for coupling the ink container and the waste ink container, and forming an ink guide path for guiding the ink flown from the atmosphere communication hole to a predetermined position of the ink container or the waste ink container. An elastic body has a domed shape, and is used at a coupling portion in one of or both of the ink container and the waste ink container, the coupling portion for coupling the containers to the printing apparatus.

44 Claims, 22 Drawing Sheets

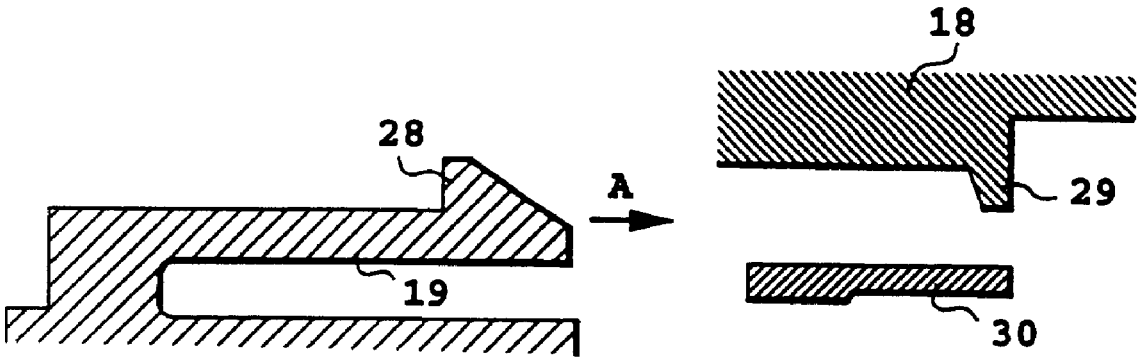
FIG. 9A
FIG. 9B
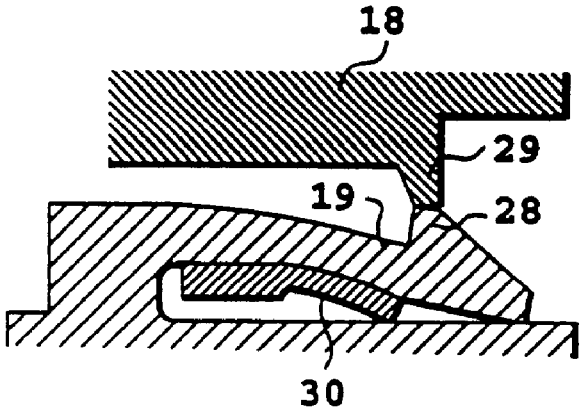
FIG. 9C
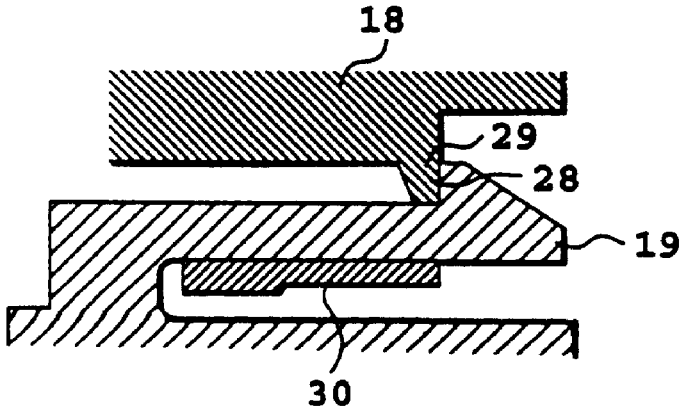

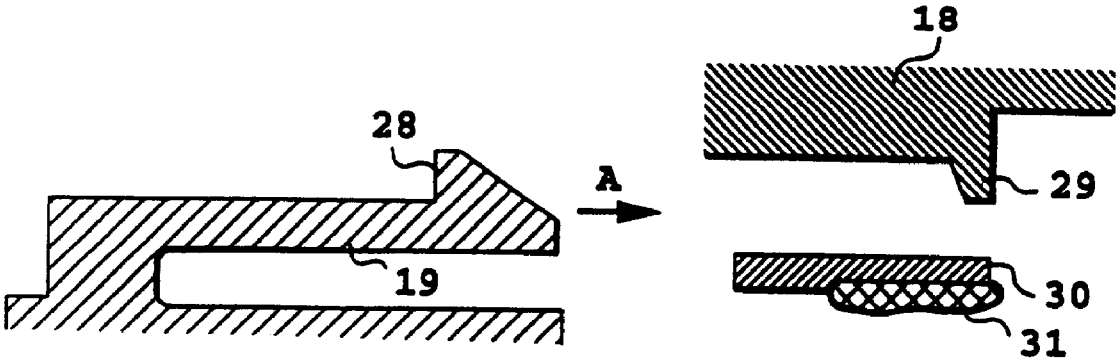
FIG.10A
FIG.10B
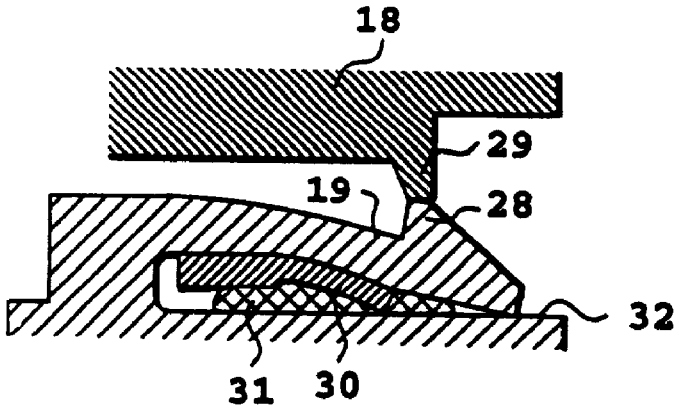
FIG.10C
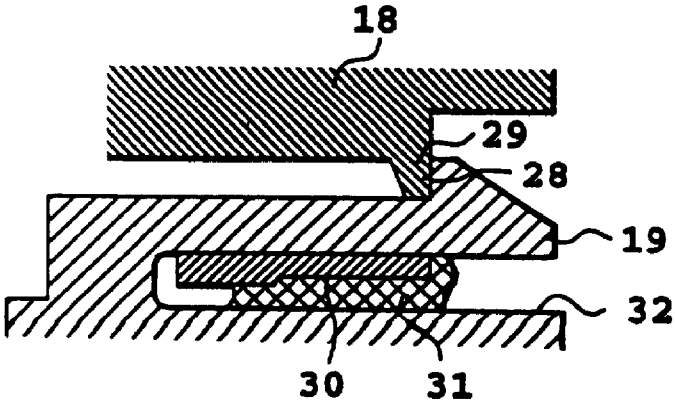

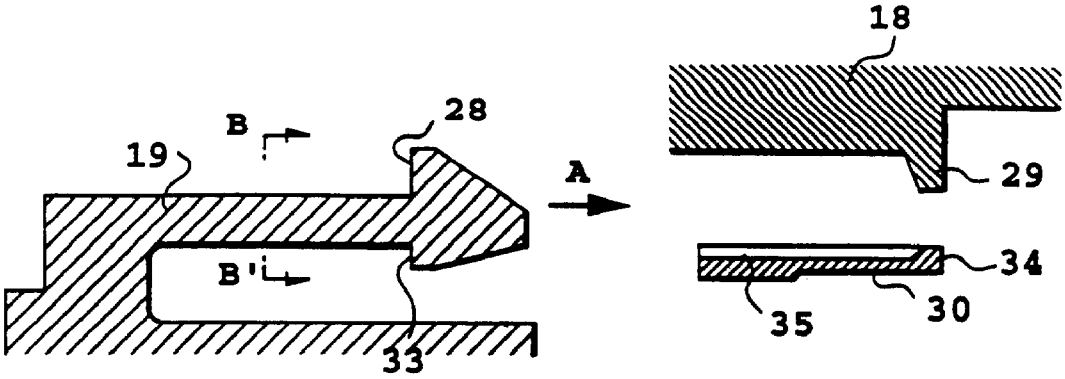
FIG.11A
FIG.11B
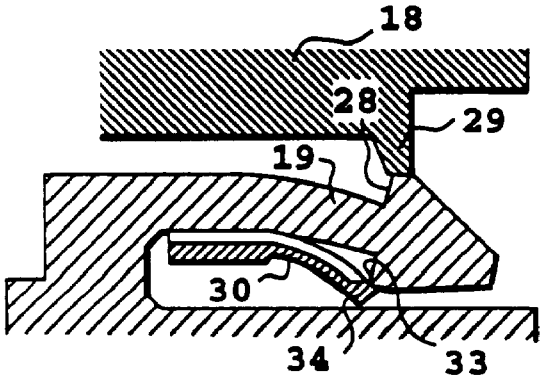
FIG.11C
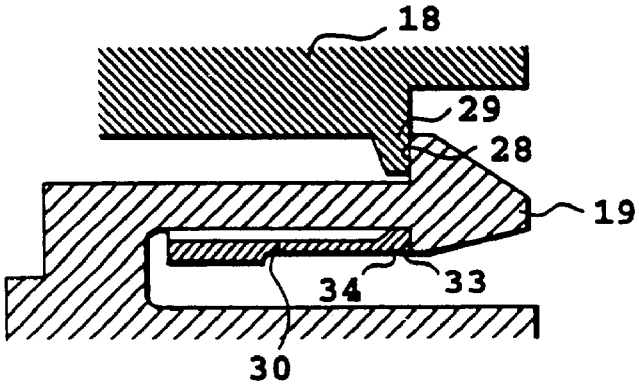
FIG.11D
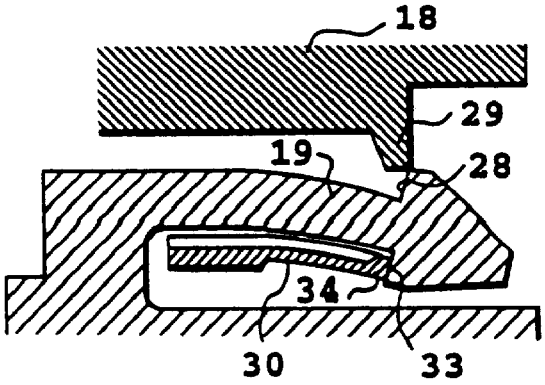

INK TANK, PRODUCTION PROCESS OF INK TANK AND INK-JET PRINTING APPARATUS

BACKGROUND OF THE INVENTION

1. Field of the Invention

The present invention relates to an exchangeable type ink tank to be employed in an ink-jet printing apparatus and a production process therefor.

2. Description of the-Prior Art

As one example of the conventional exchangeable ink tank, an ink cartridge in a form illustrated in FIGS. 1 and 2 has been known in the art. FIG. 1 is an illustration showing a detail of the ink cartridge, and showing side elevation in section. FIG. 2 is a section showing a major part, such as an ink coupling portion of the ink cartridge or so forth.

As shown in FIGS. 1 and 2, an ink cartridge 10 includes an ink storage chamber 1 and a waste ink storage chamber 2. At the end of the ink storage chamber 1, rubber plugs 4 for piercing ink supply needle (not shown) at an ink-jet head side therethrough, are provided at two portions. Similarly, another rubber plug 4 is provided at the end portion of the waste ink storage chamber 2 at one portion. These rubber plugs 4 form a part of the ink coupling portion. Except for an ink communication portion 3 where the ink supply needle pierces, the rubber plug 4 is clamped by a housing 5 of the ink cartridge, an ink absorbing body 6 and a rubber plug retainer 7. With this construction, when the ink cartridge is removed from a printer, the ink stuck to the ink supply needle drawn from the cartridge associated with removable of the ink cartridge can be removed by the ink absorbing body 6. Thus, contamination of the inside of the printer by the ink stuck to the supply needle or plugging of the supply needle per se can be successfully prevented.

The waste ink storage chamber 2 is formed with two layer of storage portions mutually communicated at one ends. In the waste ink storage chamber 2, the portion where the ink supply needle pierces is located corresponding to the position corresponding to the lower layer storage portion. Namely, in the waste ink storage chamber 2, the supply needle connected to an ink supply passage of an ink-jet printing apparatus, passes through so that the waste ink discharged by the ejection recovery process and so forth may flow into the lower layer storage portion. Absorbing body 8 is filled in substantially whole waste ink storage chamber 2 so that the waste ink flowing into the lower layer storage portion can be absorbed by the absorbing body 8 in the lower layer storage portion. According to flow of the waste ink, region of the absorbing body 8 retaining the waste ink is gradually expanded to the absorbing body 8 in the upper layer storage portion. In conjunction therewith, a part of the waste ink exude from the absorbing body. On the other hand, a partitioning wall 2A is provided adjacent the end portion of the waste ink absorbing body 8 in the upper layer storage portion. By this, the ink exuding from the absorbing body 8 cannot flow into a portion right side of the partitioning wall 2A where the absorbing body is not filled until the amount of the waste ink exceeds a holding capacity of the absorbing body. Only when the accumulated waste ink amount flown into the waste ink storage chamber 2 exceeds the ink holding capacity of the absorbing body, the exuded ink overflows the partitioning wall 2A to move into the chamber at the right side and the level of the ink is gradually risen to contact with a waste ink detecting electrode d at a predetermined level. As a result, the waste ink storage chamber 2 filled with the waste ink can be detected to allow to urge exchanging of the ink cartridge. Also, at the upper side of the read end portion of the waste ink storage chamber 2, an atmosphere communicating portion 9 is provided. Via this communicating portion 9, the interior of the waste ink storage chamber 2 and the atmosphere outside of the ink cartridge are communicated.

However, since the ink storage chamber 1 and the waste ink storage chamber 2 are formed integrally in the conventional ink tank, the following problems to be solved are left mainly in viewpoint of production.

For example, the ink cartridge shown in Fig, 1 is required to weld a lid for integrally covering the ink storage chamber 1 and the waste ink storage chamber 2, namely the lid covering the entire surface of the cartridge as shown in FIG. 1, during production. In such production process, the following problems are encountered.

a) It is possible that debris of absorbing body constantly generated from the adjacent absorbing body 8 during production, may penetrate into the ink storage chamber 1, penetration of dart into which is not desirable. On the other hand, it is not easy to perform production with avoiding penetration of the debris of the absorbing body into the ink storage chamber 1 or to manage the dust.

b) On the other hand, installation of the lid has to be performed by welding to seal respective chambers. However, as shown in FIG. 1, since the area to be welded is relatively large, a difficulty is frequently encountered to perform complete welding due to bowing of respective members. Particularly, it is relatively difficult to certainly weld the lid so as not to communicate the ink through the partitioning portion which separates the ink storage chamber 1 and the waste ink storage chamber 2.

On the other hand, as shown in FIG. 2, the external diameter of the rubber plug 4 is formed to be greater than the internal diameter of the housing portion 5 in independent condition. The rubber plug 4 is thus assembled in the housing portion 5 along the direction of allow B with compressing in the diametrical direction (direction of arrow A in FIG. 2) by means of a predetermined device.

However, in the prior art, since the rubber plug 4 is assembled into the housing portion 5 with compressing in the diametrical direction, the following drawbacks are encountered.

Namely, since it is not easy to uniformly compress the elastic body, such as the rubber plug or so forth in the diametrical direction, c) expensive device is required to require excessively high cost for small-lot production;

d) when the size of the elastic body is slightly varied, new device becomes necessary for compression thereof;

e) when the ink communication portion is extremely small, a space to insert the device for compressing the elastic body cannot be provided;

f) the performance of the product can be fluctuated depending upon the condition of the quality of the device for compressing the elastic body;

g) buckling of the elastic body relative to the internal wall of the housing can be caused;

h) variation of the elastic body and new assembling device are required for forming optimal ink communicating portion with respect to a needle size; and i) for difficulty of assembling, assembling is performed before filling the ink and filling of the ink is performed thereafter by means of the needle, thus longer period is required since the diameter of the needle cannot be made to be sufficiently large, and excessively large needle may cause damage on the elastic body.

SUMMARY OF THE INVENTION

It is the first object of the present invention to provide an ink tank which can reduce penetration of dust into an ink storage chamber in production process, enhance sealing ability. of the ink storage chamber and a waste ink storage chamber, and thus is reliable and convenient for use.

It is the second object of the present invention to provide an ink-jet printing apparatus employing the ink tank set forth above.

The third object of the present invention is to provide an exchangeable type ink tank which has an ink coupling portion which can be optimally and stably adapted to various requests irrespective of condition of the device without requiring expensive device, and has superior productivity.

The fourth object of the present invention is to provide a production process of the ink tank which facilitates assembling operation for permitting filling of ink before installation of an elastic body so that a pipe or so forth having much greater side than a needle or so forth having large flow resistance to reduce flow resistance, and whereby to reduce process steps in production to improve productivity and to avoid damage of the elastic body which can be caused by piercing and removing of the needle.

The fifth object of the invention is to provide an exchangeable ink tank for increasing freedom in designing and enhanced reliability with respect to the ink tank having high reliability.

In a first aspect of the present invention, there is provided an ink tank for storing an ink to be used in a printing apparatus and an ink used in the printing apparatus, comprising:

an ink container storing the ink to be used in the printing apparatus;

a waste ink container storing the ink used in the printing apparatus;

an atmosphere communication hole provided in the waste ink container; and a coupling member provided on one of or both of the ink container and the waste ink container and provided for coupling the ink container and the waste ink container, and the coupling member forming an ink guide path for guiding the ink flowed from the atmosphere communication hole to a predetermined position of the ink container or the waste ink container.

Here, the ink guide path may be formed by a guide surface of coupling operation in the coupling member.

The ink guide path may be formed by a groove formed on guide surface of coupling operation in the coupling member.

The ink tank may further include a label pasted over both of the ink container and the waste ink container as a member forming the ink guide path.

The coupling member may have an engaging recess portion, an engaging snap portion engaged with the recessed portion by elastic deformation, and a spring portion biasing the engaging snap portion in a direction for fixing engagement with the recessed portion.

The snap portion may include engaging claws respectively engaging with the engaging recess portion and the spring portion at the tip ends.

The projecting portion to contact with a predetermined member of the printing apparatus associating with loading operation to the printing apparatus, may be provided on a coupling surface in the ink container to be coupled with the printing apparatus.

The ink may be filled in the ink container.

In a second aspect of the present invention, there is provided an ink-jet printing apparatus for performing printing on a printing medium employing an ink-jet head, in which an ink tank for storing an ink to be used in a printing apparatus and an ink used in the printing apparatus, the ink tank, comprising:

an ink container storing the ink to be used in the printing apparatus;

a waste ink container storing the ink used in the printing apparatus;

an atmosphere communication hole provided in the waste ink container; and a coupling member provided on one of or both of the ink container and the waste ink container and provided for coupling the ink container and the waste ink container, and forming an ink guide path for guiding the ink flown from the atmosphere communication hole to a predetermined position of the ink container or the waste ink container.

In a third aspect of the present invention, there is provided an ink tank comprising:

an ink container storing an ink employed in a printing apparatus;

a cylindrical hole provided in the ink container and adapted for supplying the ink;

an elastic body closing the cylindrical hole and pierced by a needle body for supplying the ink to the printing apparatus; and a fixing member for maintaining closure of the cylindrical hole by the elastic body, wherein the elastic body has a dome shaped configuration having substantially the same diameter to an internal diameter of the cylindrical hole.

In a fourth aspect of the present invention, there is provided an ink tank, comprising:

a waste ink container for storing an ink used in a printing apparatus;

a cylindrical hole provided in the waste ink container for introducing the waste ink;

an elastic body closing the cylindrical hole and pierced by a needle body for introducing the ink from the printing apparatus; and a fixing member for maintaining closure of the cylindrical hole by the elastic body, wherein the elastic body has a dome shaped configuration having substantially the same diameter to an internal diameter of the cylindrical hole.

In a fifth aspect of the present invention, there is provided an ink tank, comprising:

an ink container storing an ink employed in a printing apparatus;

a waste ink container for storing an ink used in a printing apparatus;

a first cylindrical hole provided in the ink container and adapted for supplying the ink;

a second cylindrical hole provided in the waste ink container for introducing the waste ink;

a first elastic body closing the first cylindrical hole;

a second elastic body closing the second cylindrical hole; and a fixing member for maintaining closure of the first and second cylindrical holes by the first and second elastic bodies, wherein the first and second elastic bodies have dome shaped configurations having substantially the same diameter to an internal diameters of the first and second cylindrical holes.

Here, the elastic body may be received in an end portion of the cylindrical hole, and a housing portion having greater internal diameter than the cylindrical hole may be provided.

The fixing member may have a pushing portion for depressing a top portion of the elastic body received in the housing portion for causing elastic deformation within the housing.

Assuming that the internal radius of the housing is r and a curve radius of the elastic body in non-deformed condition is R, $$1.05<(R/r)\sin^{-1}(r/R)<1.57$$

may be satisfied.

Assuming that the internal radius of the housing is r and a curve radius of the elastic body in non-deformed condition is R.

$$1.1<(R/r)\sin^{-1}(r/R)<1.4$$

may be satisfied.

The ink may be filled in the ink container.

In a sixth aspect of the present invention, there is provided an ink-jet printing apparatus for performing printing on a printing medium employing an ink-jet head, comprising:

ink supply system including:

an ink container storing an ink employed in a printing apparatus;

a cylindrical hole provided in the ink container and adapted for supplying the ink;

an elastic body closing the cylindrical hole and pierced by a needle body for supplying the ink to the printing apparatus; and a fixing member for maintaining closure of the cylindrical hole by the elastic body, wherein the elastic body including a needle body piercing the elastic body which is a dome shaped configuration having substantially the same diameter to an internal diameter of the cylindrical hole, for receiving an ink supply from the ink tank.

In a seventh aspect of the present invention, there is provided an ink-jet printing apparatus for performing printing on a printing medium employing an ink-jet head, comprising:

ink supply system including:

a waste ink container for storing a waste ink discharged from the printing apparatus in recovery operation of the ink-jet head;

a cylindrical hole provided in the waste ink container for introducing the waste ink;

an elastic body closing the cylindrical hole; and a fixing member for maintaining closure of the cylindrical hole by the elastic body, wherein the elastic body having waste ink processing means including a needle body piercing the elastic body a dome shaped configuration having substantially the same diameter to an internal diameter of the cylindrical hole, for introduction of the waste ink into the ink tank.

In an eighth aspect of the present invention, there is provided an ink-jet printing apparatus for performing printing on a printing medium employing an ink-jet head, comprising:

ink supply system including:

an ink container storing an ink employed in a printing apparatus;

a waste ink container capable of being coupled with the ink container for storing a waste ink discharged from printing apparatus by recovery operation of the ink-jet head;

a first cylindrical hole provided in the ink container and adapted for supplying the ink;

a second cylindrical hole provided in the waste ink container for introducing the waste ink;

a first elastic body closing the first cylindrical hole;

a second elastic body closing the second cylindrical hole;

a fixing member for maintaining closure of the first and second cylindrical holes by the first and second elastic bodies, wherein the first and second elastic bodies including ink supply means having a first needle body piercing the first elastic body a dome shaped configuration having substantially the same diameter to an internal diameter of the cylindrical hole, and waste ink processing means having a second needle body piercing the second elastic body.

In a ninth aspect of the present invention, there is provided a production process of an ink tank, comprising the steps of:

inserting a dome shaped elastic body having an external diameter substantially equal to an internal diameter of a cylindrical hole which is provided for injecting an ink and provided in an ink container for storing the ink, with compressing the elastic body; and fixing the elastic body by a fixing member for maintaining closure of the cylindrical hole.

In a tenth aspect of the present invention, there is provided a production process of an ink tank, comprising the steps of:

inserting a dome shaped elastic body having an external diameter substantially equal to an internal diameter of a cylindrical hole which is provided for introducing an ink used in a printing apparatus and provided in a waste ink container for storing the ink used in the printing apparatus, with compressing the elastic body; and fixing the elastic body by a fixing member for maintaining closure of the cylindrical hole.

In an eleventh aspect of the present invention, there is provided a production process of an ink tank, comprising the steps of:

employing a coupled body in which a first cylindrical hole for injecting an ink, an ink container storing the ink to be used in a printing apparatus, a second cylindrical hole for introducing a waste ink, a waste ink container storing the ink used in the printing apparatus are coupled;

inserting a dome shaped first elastic body having an external diameter substantially the same as an internal diameter of the first cylindrical hole, with compressing the first elastic body;

inserting a dome shaped second elastic body having an external diameter substantially the same as an internal diameter of the second cylindrical hole, with compressing the second elastic body; and fixing the first elastic body and the second elastic body for maintaining closure of respective of the cylindrical holes.

In a twelfth aspect of the present invention, there is provided an ink tank, comprising:

an ink container for storing an ink employed in a printing apparatus;

a cylindrical hole provided in the cylindrical container and used for injecting the ink;

an elastic body for closing the cylindrical hole and being pierced by a needle body for supplying the ink to the printing apparatus; and a fixing member for maintaining closure of the cylindrical hole by the elastic body, a housing portion being provided at an end of the cylindrical hole for receiving the elastic body, the housing portion having an elastic body receptacle portion having an internal diameter greater than an internal diameter of the cylindrical hole, the fixing member having a pushing portion for depressing a top portion of the elastic body received within the elastic body receptacle portion of the housing portion to cause elastic deformation of the elastic body, and a plurality of claw portions used for coupling with the housing portion, and engaging portions being provided on an outer periphery portion of the housing for engaging with the plurality of engaging claw portions of the fixing member.

In a thirteenth aspect of the present invention, there is provided an ink tank, comprising:

a waste ink container for storing an ink used in a printing apparatus;

a cylindrical hole provided in the waste ink container and introducing a waste ink;

an elastic body for closing the cylindrical hole and being pierced by a needle body for introducing the waste ink from the printing apparatus; and a fixing member for maintaining closure of the cylindrical hole by the elastic body, a housing portion being provided at an end of the cylindrical hole for receiving the elastic body, the housing portion having an elastic body receptacle portion having an internal diameter greater than an internal diameter of the cylindrical hole, the fixing member having a pushing portion for depressing a top portion of the elastic body received within the elastic body receptacle portion of the housing portion to cause elastic deformation of the elastic body, and a plurality of claw portions used for coupling with the housing portion, and engaging portions being provided on an outer periphery portion of the housing for engaging with the plurality of engaging claw portions of the fixing member.

Here, the engaging portion of the housing portion may be a groove guiding the claw portion of the fixing member, the groove including a first groove portion extending on the outer periphery portion of the housing portion along an axis of the cylindrical hole and a second groove portion communicated with the first groove portion and extending in a direction intersecting with the direction along which the first groove portion extends.

In the second groove portion, the engaging portion engaging with the claw portion of the fixing member may be provided.

The elastic body may be of a dome shaped configuration having an external diameter substantially equal to an internal diameter of the elastic body receptacle portion of the fixing member.

Assuming that the internal radius of the housing is r and a curve radius of the elastic body in non-deformed condition is R, $$1.05<(R/r)\sin^{-1}(r/R)<1.57$$

may be satisfied.

Assuming that the internal radius of the housing is r and a curve radius of the elastic body in non-deformed condition is R, $$1.1<(R/r)\sin^{-1}(r/R)<1.4$$

may be satisfied.

The ink may be filled in the ink container.

In a fourteenth aspect of the present invention, there is provided a production process of an ink tank, comprising the steps of:

inserting an elastic body within an elastic body receptacle portion having an internal diameter greater than an internal diameter of the cylindrical hole of a housing provided at an end of the cylindrical hole used for injecting an ink; and fitting a fixing member having a pushing portion depressing the elastic body for causing elastic deformation and a plurality of claw portions engaging with engaging portions of the housing for causing elastic deformation of the elastic body by the pushing portion for closing the cylindrical hole.

In a fifteenth aspect of the present invention, there is provided a production process of an ink tank, comprising the steps of:

inserting an elastic body within an elastic body receptacle portion having an internal diameter greater than an internal diameter of the cylindrical hole of a housing provided at an end of the cylindrical hole used for introducing a waste ink; and fitting a fixing member having a pushing portion depressing the elastic body for causing elastic deformation and a plurality of claw portions engaging with engaging portions of the housing for causing elastic deformation of the elastic body by the pushing portion for closing the cylindrical hole.

In a sixteenth aspect of the present invention, there is provided an ink tank for storing an ink to be used in a printing apparatus and an ink used in the printing apparatus, comprising:

an ink container storing the ink to be used in the printing apparatus;

a waste ink container storing the ink used in the printing apparatus;

an atmosphere communication hole provided in the waste ink container; and a coupling member provided on one of or both of the ink container and the waste ink container and provided for coupling the ink container and the waste ink container, and the coupling member forming an ink guide path for guiding the ink flowed from the atmosphere communication hole to a predetermined position of the ink container or the waste ink container, wherein a coupling portion is provided on one of or both of the ink container and the waste ink container, for coupling the ink container or the waste ink container to a printing apparatus, the coupling portion, including:

a cylindrical hole;

an elastic body received so as to close the cylindrical hole and pierced by a needle body for supplying the ink to the printing apparatus; and a fixing-member for maintaining closure of the cylindrical hole by the elastic body, the elastic body being a dome shaped configuration having substantially the same diameter to an internal diameter of the cylindrical hole.

Here, the ink guide path may be formed by a guide surface of coupling operation in the coupling member.

The coupling member may have an engaging recess portion, an engaging snap portion engaged with the recessed portion by elastic deformation, and a spring portion biasing the engaging snap portion in a direction for fixing engagement with the recessed portion.

The ink may be filled in the ink container.

Assuming that the internal radius of the housing is r and a curve radius of the elastic body in non-deformed condition is R, $$1.05<(R/r)\sin^{-1}(r/R)<1.57$$

may be satisfied.

Assuming that the internal radius of the housing is r and a curve radius of the elastic body in non-deformed condition is R, $$1.1<(R/r)\sin^{-1}(r/R)<1.4$$

may be satisfied.

The fixing member may have a pushing portion for depressing a top portion of the elastic body received within the elastic body receptacle portion of the cylindrical hole to cause elastic deformation of the elastic body, and a plurality of claw portions used for coupling with the cylindrical hole, and engaging portions being provided on an outer periphery portion of the cylindrical hole for engaging with the plurality of engaging claw portions of the fixing member.

The above and the other objects, effects, features and advantages pf the present invention will become more apparent from the following description of the embodiments thereof taken in conjunction with the accompanying drawings.

BRIEF DESCRIPTION OF THE DRAWINGS

FIGS. 9A, 9B and 9C are sections for explaining engagement between the ink storage portion and the waste ink storage portion in the foregoing embodiment of the ink tank;

FIGS. 10A, 10B and 10C are sections for explaining another example of the foregoing engagement;

FIGS. 11A, 11B, 11C and 11D are sections for explaining further example of the foregoing engagement;

DETAILED DESCRIPTION OF THE PREFERRED EMBODIMENT

The present invention will be discussed hereinafter in detail in terms of the preferred embodiments of the invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 3:
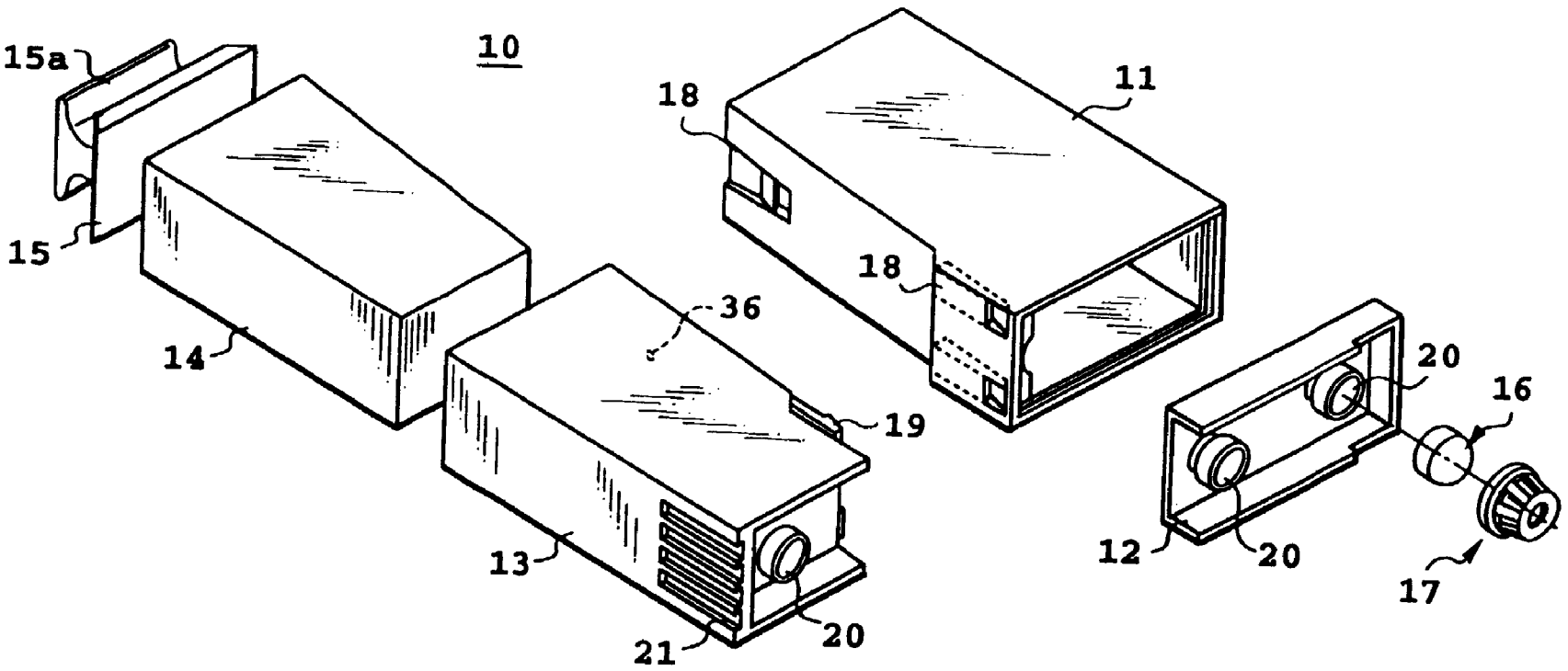
FIG. 3 is an exploded perspective view showing one embodiment of an ink tank according to the present invention.

FIG. 3 is an exploded perspective view showing one embodiment of an ink cartridge according to the present invention. The reference numeral 11 denotes an ink container and 12 denotes a lid of the ink container 11. These components forms an ink storage chamber 1. On the other hand, the reference numeral 13 denotes a waste ink container, in which an absorbing body 14 is housed. The absorbing body 14 is for absorbing and maintaining ink collected in the waste ink container 13. A waste ink lid 15 is mounted on the waste ink container housed therein the absorbing body 14. By this, a waste ink storage chamber is formed. With respect to the ink container 11, the lid 12 is mounted by way of ultrasonic welding. On the other hand, the waste ink container 13 and the waste ink lid 15 are assembled by way of ultrasonic welding.

Figure 4:
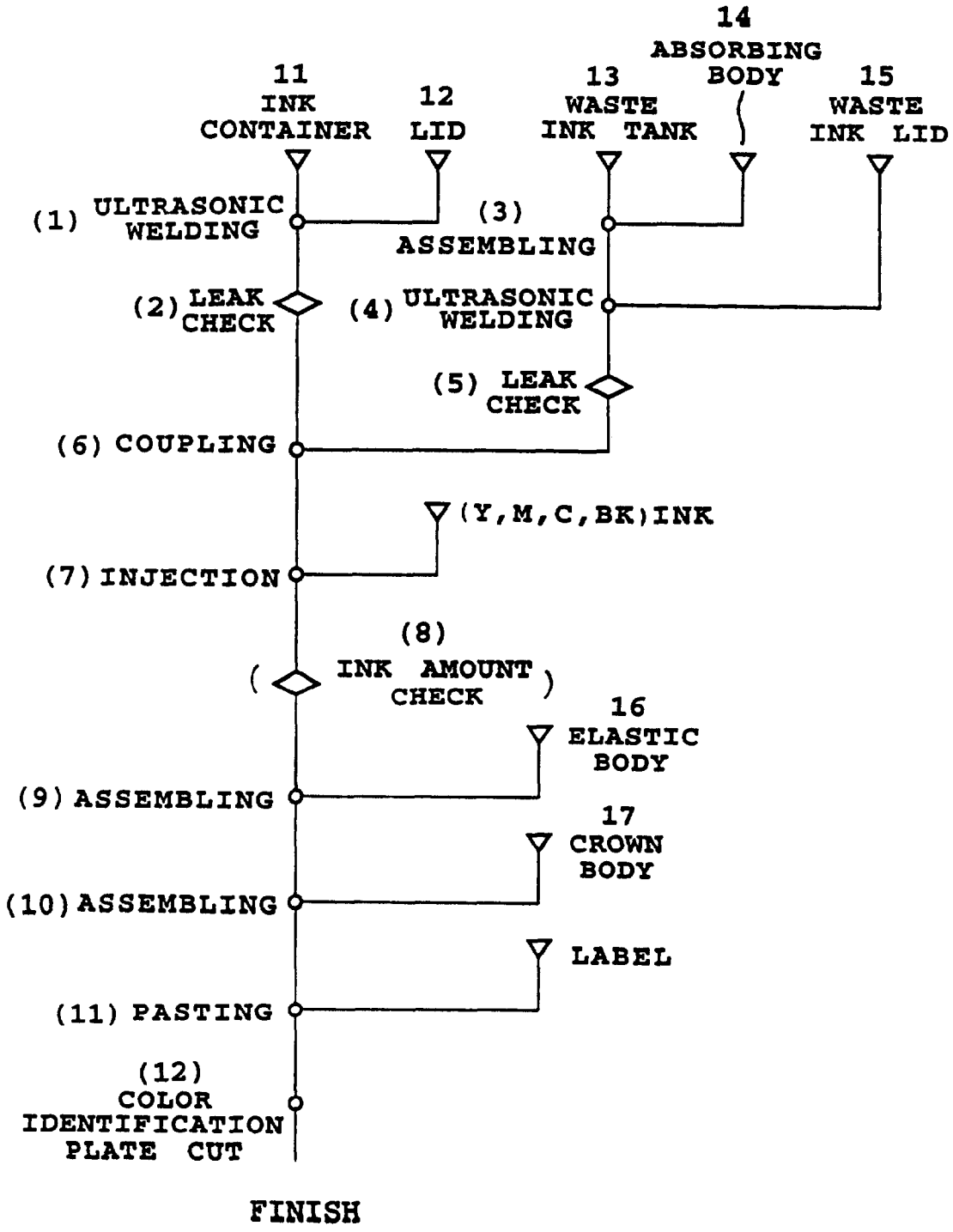
FIG. 4 is a flowchart showing assembling process of the above-mentioned embodiment of the ink tank.

In the lid 12 of the ink container 11 and one end of the waste ink container 13, housings 20 defining communication passages are provided, respectively. A dome shaped elastic body 16 is assembled to each of the communication passages. Also, a crown body 17 is further assembled. By this, a coupling portion with the apparatus main body for flowing the ink and so forth is formed. The ink container 11 and the waste ink container 13 are engaged and integrated by engaging portions 18 and engaging claws 19 as discussed later, to form an ink tank, namely, an ink cartridge. Hereinafter, as shown in FIG. 4, according to flow of an ink cartridge production process, production of the shown embodiment of the ink tank will be discussed.

As the ink container 11 and the lid 12 thereof, the waste ink container 13, the waste ink lid 15 and the crown body 17, the components preliminarily formed as independent parts by injection molding are employed. On the other hand, while the elastic body 16 is a rubber material in the shown embodiment, a molded rubber or one formed by injection molding or so forth may be employed. Furthermore, as the absorbing body 14, one formed by clicking a piled paper or so forth having absorptivity by simply pressing. It should be noted that as the material of the elastic body 16, an elastomer can also be employed.

As a process step, at first, (1) the ink container 11 and the lid 12 are assembled by way of ultrasonic welding. At this time, since the ink container 11 and the lid 12 are constructional components to which the ink is directly filled, it is desirable to assemble after washing if required. (2) Next, leak check is performed for verifying condition of welding portion of the assembled ink container 11 and the lid 12. This can be done by using one of two housings (see FIG. 3) as a pressure detecting hole, pressurizing the interior space via the other and performing check whether the internal pressure is held unchanged for a given period. It should be noted that if the welding per se is stable, it is possible to perform the leak check for all but for some as samples or not to perform the leak check.

(3) Next, the absorbing body 14 is housed within the waste ink container 13, and (4) the waste ink lid 15 is assembled to the waste ink container 13 by ultrasonic welding. (5) Even in this case, leak check of the welding portion is performed if required. It should be noted that, even in this case, pressurization of the internal space may be performed via the atmosphere communication hole 36 (see FIG. 3).

(6) The ink container and the waste ink container assembled without leak as set forth above, are integrated. This integration is enabled by engaging the engaging portions 18 provided in the ink container 11 and the engaging claws 19 provided in the waste ink container 13.

(7) Next, the container 11 is set in an ink filler machine with orienting the side where the housing 20 of the ink container 11 is provided upwardly. Then, using one of the housing 20 in the lid 12 as filler opening and the other housing as ventilation opening for the internal air, necessary amount of ink ius supplied. (8) Thereafter, weight check or so forth is performed as verification of filled amount of the ink as required.

When filling of the ink is completed, (9) the elastic bodies 16 are assembled to the housings 20 of the ink container, and the waste ink container, respectively, (10) and then the crown bodies 17 are fitted to the elastic body 16. Thus, assembly of the coupling portion is completed. Thereafter, (11) a label (not shown) is attached on a portion of the side surfaces of the ink container and the waste ink container. (12) On the other hand, upon loading to the apparatus main body, a color identification plate 21 may be cut into a pattern corresponding to the ink color.

Through the foregoing process, the ink cartridge is completed. It should be noted that the foregoing flow is merely one example, and it is the matter of course that the assembling operation is performed in the shown order.

Figure 5:
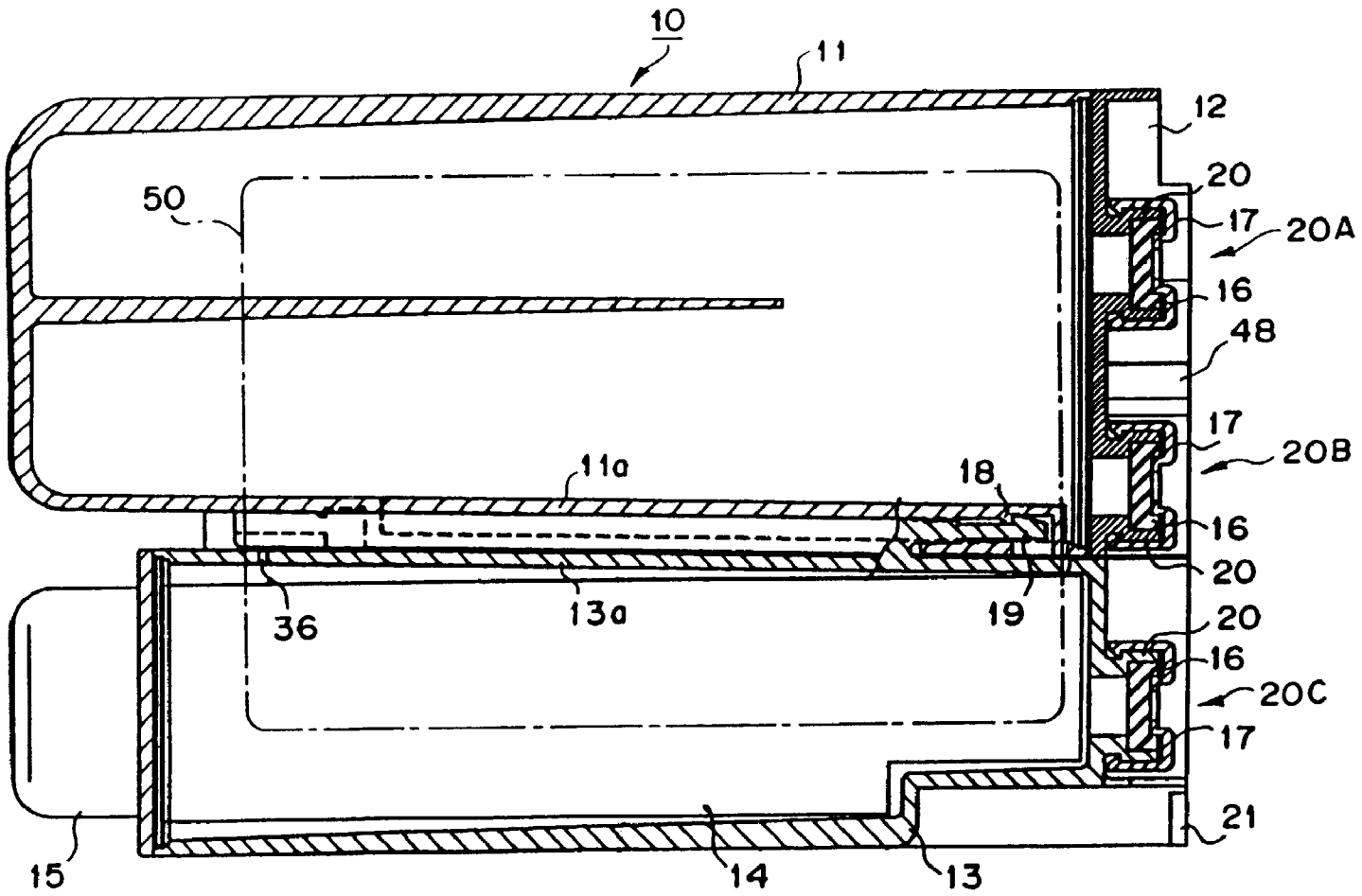
FIG. 5 is a section of the foregoing embodiment of the ink tank.

FIG. 5 shows a section of the completed ink cartridge.

As can be clear from the discussion for the production process as set forth above, the process step for assembling the ink container 11 and the lid 12 and the process step for housing the absorbing body 14 within the waste ink container 13 and assembling the waste ink lid 15 are performed in the completely separate process steps. Therefore, it can be successfully avoided to contaminate the ink container 11 particularly by the debris of the absorbing body 14.

On the other hand, inspection can be done easily since checking whether the welding of the ink container and the waste ink container is firmly performed or not can be checked independently. Also, even when failure of welding is caused, restriction of the portion where the welding-failure occurs, is easy to facilitate investigation of the cause and taking measure. By this, the failure due to nonconformity in assembling condition or so forth, may not be continued for a long period. On the other hand, measure should be taken for the failure of one of the ink container and the waste ink container to improve yield and to permit to provide reliable ink tank. Furthermore, as can be clear from the drawings, since the area to be-welded can be made significantly smaller than that in the prior art, welding can be made stable against bowing of the part, dimensional fluctuation or so forth. Also, a large welding device is not required. Also, by utilizing these effect conversely, the ink cartridge having greater capacity than that in the conventional ink cartridge can be produced.

On the other hand, by making the area to be welded smaller, it is possible to weld materials, such as polypropylene (P. P.), polybutylene terephthalate (P. B. T.) or so forth which have high gas barrier property and thus is ideal as material for the ink tank container but is difficulty to be practically used for low weldability. The materials can be preferably used as a constructional material for an ink tank. Particularly, since the PP material is low in material cost and have transparency, it would be convenient for the user to form the tank container with the PP material for capability of visually checking a remaining amount of the ink.

Next, in FIG. 5, a bottom surface 11*a* of the ink container is formed to be lower at the coupling portion side in the condition where the ink container 11 is integrated with the waste ink container 13. By this, when the remaining amount of the ink becomes small, the ink can be concentrated at the side of the coupling portion 20B. It should be noted that the gradient of the bottom surface can be formed by utilizing draft angle upon formation of the ink container 11 by way of injection molding.

The atmosphere communication hole 36 provided in the waste ink container 13 maintains the interior of the waste ink container 13 at atmospheric pressure, and whereby makes flow of the waste ink via the coupling portion 20C from the apparatus main body smooth. The atmosphere communication hole 36 is located away from the coupling portion 20C of the waste ink container 13. Since the position where the atmosphere communication hole 36 is relatively high position in the waste ink container 13 and thus is positioned at a position where, even if the collected waste ink becomes large, the waste ink may not leak out of the waste ink container even when the inside becomes full.

Figure 6:
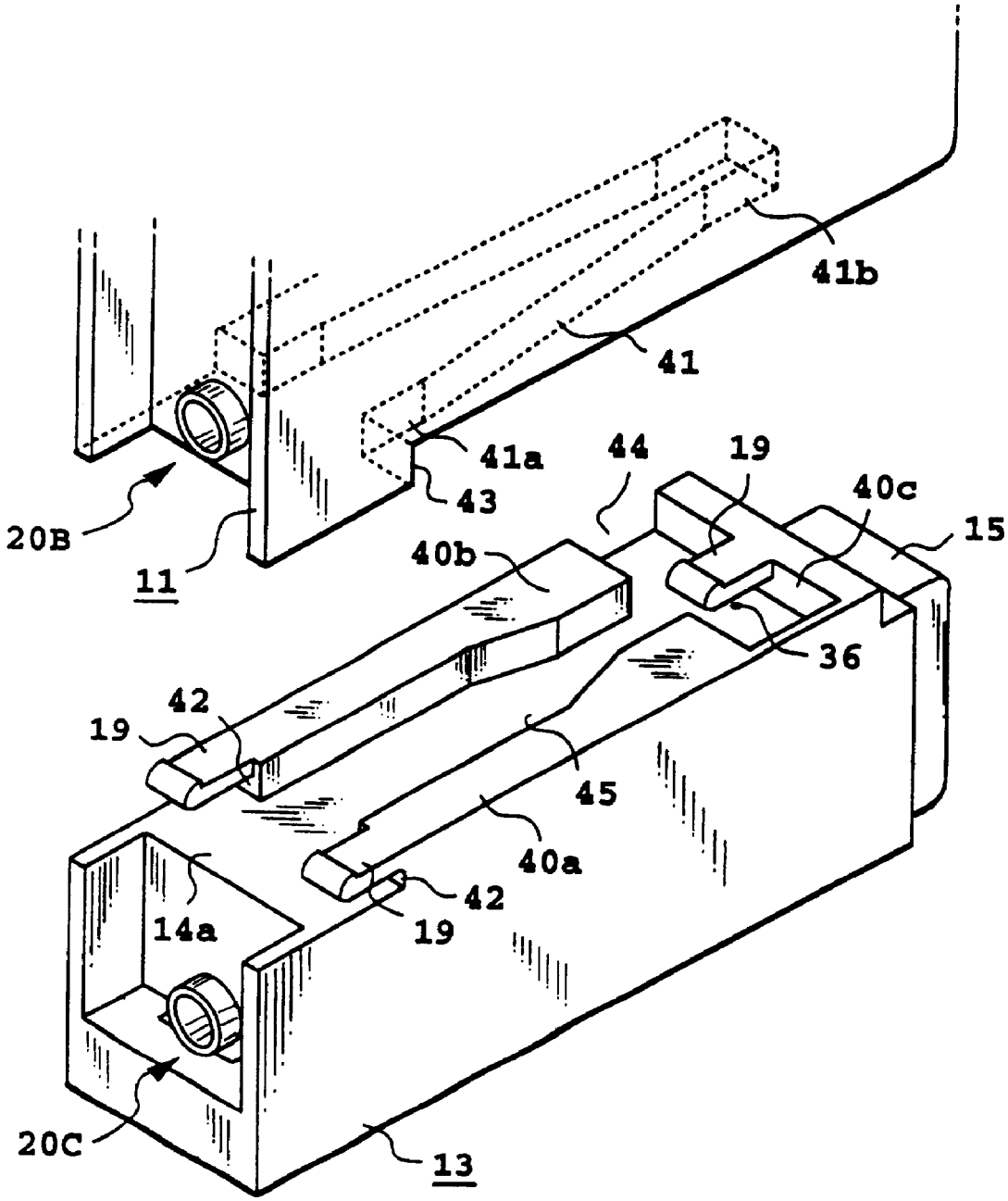
FIG. 6 is a perspective view showing an engaging portion with an ink storage portion in a waste ink storage portion forming the foregoing embodiment of the ink tank.

Furthermore, in the worst case, when the collected waste ink overflows, the ink always flows frontwardly, namely toward the side of the coupling portion 20C. Therefore, the overflow ink may not flow to handle of the waste ink lid 15, to which the user's hand may touch. This is because that the ceiling wall 13*a* of the waste ink container is lower at the side of the coupling portion 20C and a member for coupling and positioning with the ink container 11 is provided on the upper surface of the waste ink container 13 as shown in FIG. 6 to thus form a guide portion for the overflown ink. Namely, on the upper surface of the waste ink container, guide members 40*a* and 40*b* which serves for guiding for engaging operation upon engaging the engaging claws 19 with the engaging portions 18 of the ink container 11 are provided, and a wall member 40C projecting the engaging claws 19 is provided at a handle side end. Thus, a waste ink passage from the atmosphere communication hole 36 to reach the front end portion of the waste ink container 13, namely to reach the side of the coupling portion 20C.

Namely, in FIG. 6, the reference numeral 44 denotes a cut out portion required in relation to a mold upon formation of the engaging claws at the rear end side of the waste ink container. Accordingly, in some molds for injection molding, the cut-out portion 44 becomes unnecessary. Also, the cut-out portion 44 may be covered with a label adhered in a range shown by one-dotted line in FIG. 5 to make the waste ink passage set forth above as enclosed space. By this. leakage of the ink from the cut-out portion 44 can be avoided.

The gradient of the ceiling of the waste ink container 13 may also be formed utilizing draft angle similarly to the bottom surface 11*a* of the ink container 11.

Concerning the construction of the waste ink passage set forth above, when inflow pressure of the waste ink flowing into the waste container 13 upon collection of the waste ink is relative high due to specification of the apparatus or so forth, the waste ink in the container may be discharged through the atmosphere communication hole 36 to cause unnecessary ink leakage. In case of the ink cartridge to be employed in such apparatus main body, a construction shown in FIG. 7 is desired.

Namely, by providing the atmosphere communication hole 36 at the position inclined toward the coupling portion 20C than that in the case shown in FIG. 6, an ink guide groove 46 from the atmosphere communication hole 36 to the coupling portion 20 is formed. On the upper surface of the ink guide groove 46, a lid member 47 is bonded. As the lid member 47, a member like a tape can be employed.

By forming the ink guide groove for the waste ink from the atmosphere communication hole 36 to the coupling portion side, the waste ink can be certainly guided to the coupling portion side irrespective of the type of the waste ink collection system of the apparatus main body.

Figure 7:
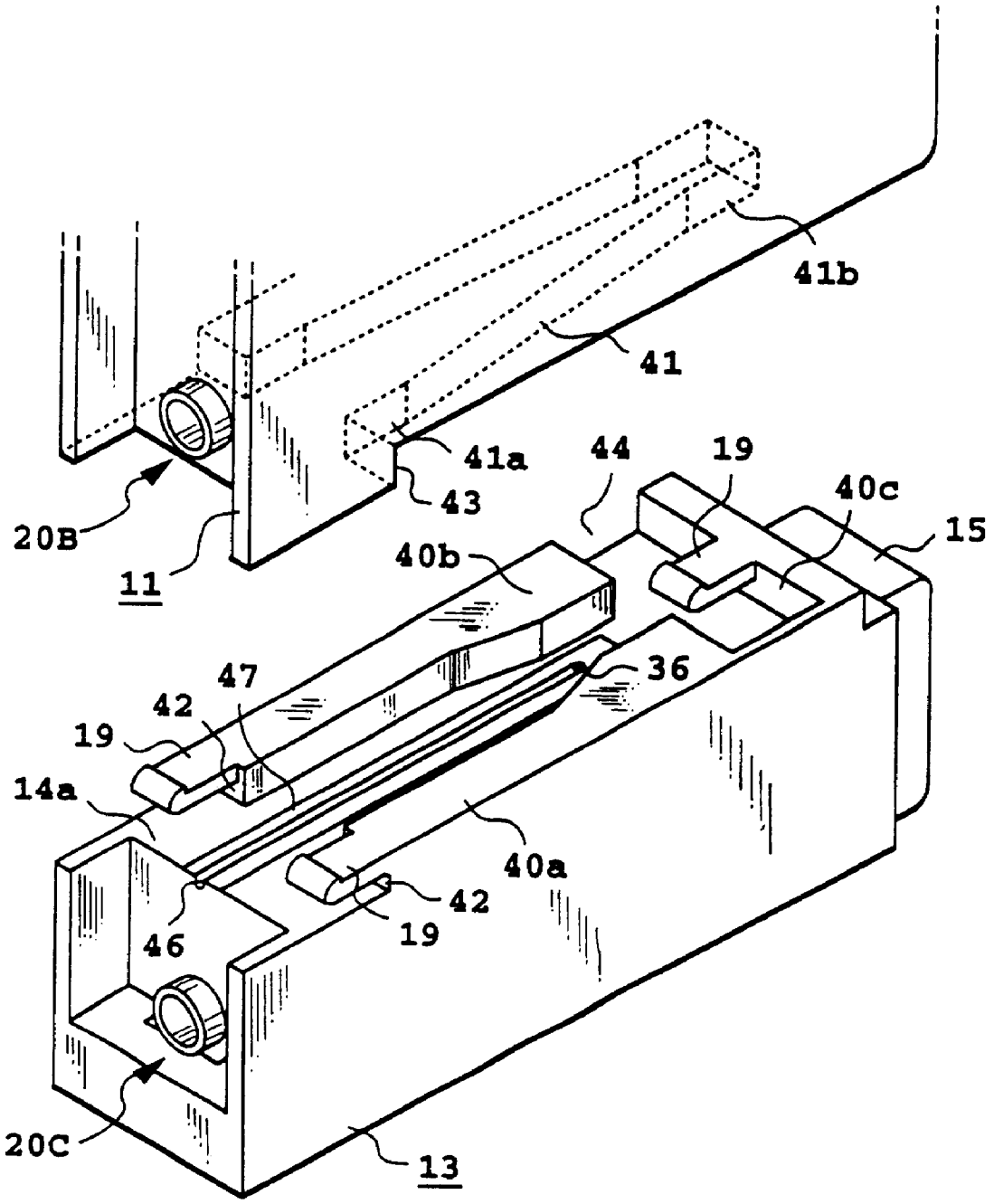
FIG. 7 is a perspective view showing another example the foregoing engaging portion.
Figure 8:
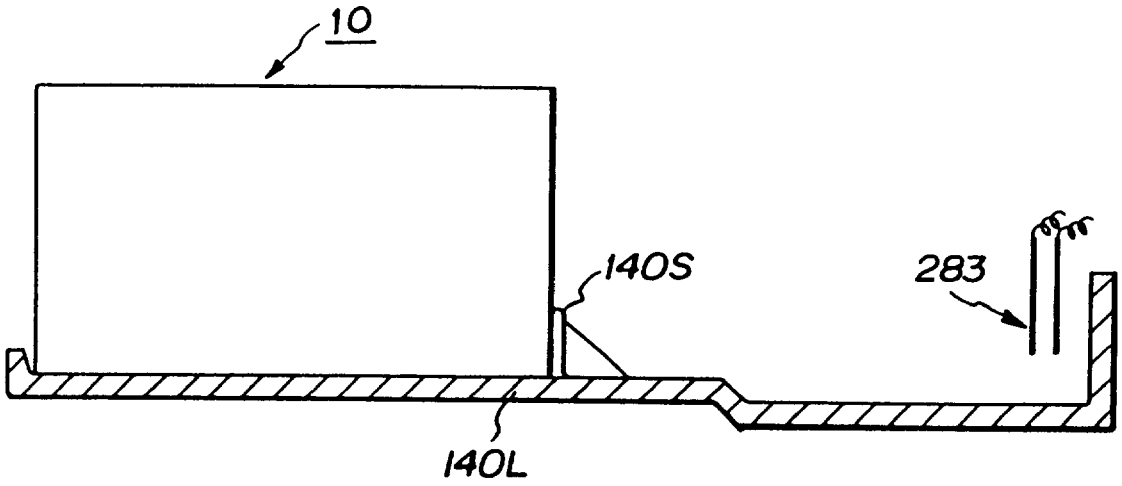
FIG. 8 is a section for explaining arrangement of the foregoing embodiment of the ink tank in an apparatus main body.

It should be noted that, in FIGS. 6 and 7, the waste ink introduced toward the coupling portion side reaches a storage lower frame 140L of the apparatus main body as shown in FIG. 8. Then, the storage lower frame 140L has a tapered portion. Thus, the waste ink is finally collected to the end portion of the storage lower frame 140L. When the waste ink accumulated at the end portion becomes a predetermined amount, the ink amount reaching the predetermined amount is detected to be taken an appropriate measure, such as discharging of the waste ink or so forth.

Next, discussion will be given for construction of the portion where the ink container 11 and the waste ink container 13 are coupled.

FIGS. 9A, 9B and 9C are enlarged section of the engaging portion 18 of the ink container 11 and the engaging claw 19 of the waste ink container 13.

In the engaging portion 18, an engaging projection 29 and a spring portion 30 opposing thereto are provided. On the other hand, in the engaging claw 19, an engaging projection 28 is similarly provided.

As shown in FIG. 9A, the engaging claw 19 is inserted into the engaging portion 18 in a direction of arrow A in the drawing, by coupling action of the ink container 11 and the waste ink container 13. Subsequently, by inserting motion, the engaging projection 28 of the engaging claw 19 shown in FIG. 9B tends to pass over the engaging projection 29 of the engaging portion 18. At this time, the engaging claw 19 is deflected about the base portion serving as fulcrum as shown by the drawing to pass over the engaging projection 29. In response to this, the spring portion is deflected as shown in the drawing. When the engaging projection 28 passes over the engaging projection 29, respective projections engage with recessed portions. On the other hand, the spring portion 30 acts for fixing engagement. By this, the engaging portion 18 and the engaging claw 19 are firmly engaged and fixed.

Here, the spring portion 30 serves for restricting the engaging claw 19 to maintain engaging condition when a force acts in a direction for releasing engaging condition. However, when a force beyond the spring force of the spring portion acts, the engaging condition may be released.

Next, with reference to FIGS. 10A to 10C, discussion will be given for a construction of semi-permanent engagement.

While the constructions per se of the engaging portion 18 and the engaging claw 19 are similar to those shown in FIGS. 9A to 9C. Here, as shown in FIG. 10A, before engagement, a material 31 to be solidified. such as adhesion consisted of epoxy resin is applied on the upper surface of the spring portion 30.

The material 31 solidified like the adhesion is preferably a type to be solidified with time. On the other hand, it is also desirable that the material is hard after solidification, namely has low elasticity.

Upon coupling of the engaging claw 19 and the engaging portion 18, the material 31 to be solidified like adhesion is not yet cured. When the engaging projection 28 passes over the engaging projection 29, the spring portion 30 is deflected as pushed by the engaging claw 19. However, since the material 31 to be solidified like adhesion is deformed, engagement between the engaging portion 18 and the engaging claw 19 is not interfered. However, once engaging condition is established, the material solidified like adhesion is solidified with time between the spring portion 30 and the wall surface 32 of the container. Accordingly, after solidification, deflection of the spring portion 30 has to be restricted. Thus, disengagement of the engaging portion becomes difficult.

In view of experiments performed by the inventor, when the material 31 to be solidified like adhesion is not applied, if the assembled ink cartridge is assembled from high position, the two container may be disassembled. In contrast to this, when the material to be solidified like the adhesion is applied, the assembled containers of the ink cartridge will never be disengaged.

On the other hand, the material 31 to be solidified like adhesion is not always required to be adhered to the spring portion 30 or the wall surface 32, and is required to be positioned at a position where the spring portion 30 may not be deflected. Therefore, it is obvious to those skilled in the art that such material is not limited to the adhesive.

Subsequently, an embodiment where engaging projection of the engaging claw is further added is illustrated in FIGS. 11A to 11C.

Similarly to the foregoing, the engaging claw 19 is assembled with respect to the engaging portion 18 in the direction as shown by the arrow A in the drawing 11 (see FIG. 11A). When the engaging projection 28 passes over the engaging projection 29, the additional engaging projection 33 also passes over the end 34 of the spring portion 30 (see FIG. 1iB). By this, as shown in FIG. 11C, a condition where engagement is completed is established. Thus. by engagement between the engaging portion 18 and the engaging portion 19, the engaging projections 29 and 28 are placed in the engaged condition via the engaging projection 33.

Even when the force acts on the ink cartridge for releasing engagement due to dropping or so forth, the engagement of the tip end 24 of the spring portion 30 and the engaging projection 33 of the engaging claw 19 may not be released. Therefore, when the force is released, the original engagement condition is resumed to maintain coupled condition (see FIG. 11C).

Figure 12:
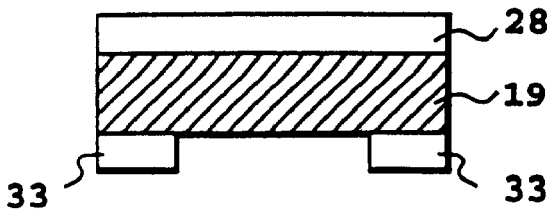
FIG. 12 is a section of an engaging portion in the engagement of FIGS. 11A to 11D.

FIG. 12 shows a section of the engaging claw 19 shown in FIG. 11A.

The engaging projections 33 take form as shown in FIG. 12. Then, by forming a groove 35 on the spring portion 30 corresponding to the engaging projection 33, it becomes possible to adapted without significantly varying the configuration from that shown in FIG. 9.

Here, referring to FIG. 6 again, positioning in the longitudinal direction upon coupling of the ink container 11 and the waste ink container 13 is done by contacting a contact portion 42 provided on the upper portion of the waste ink container 13 and a contacting portion 43 provided in the ink container 11, and by engaging the engaging portion 18 and the engaging claw 19 as set forth above. On the other hand, positioning in the direction perpendicular to the longitudinal direction is performed by the side walls of the guide members 40*a* and 40*b* of the waste ink container and contacting portions 41*a* and 41*b* of engaging member 41 provided in the ink container 11, as set forth above.

Next, discussion will be given for the coupling portions 20A, 20B and 20C (see FIG. 5) with reference to FIG. 13.

Figure 13:
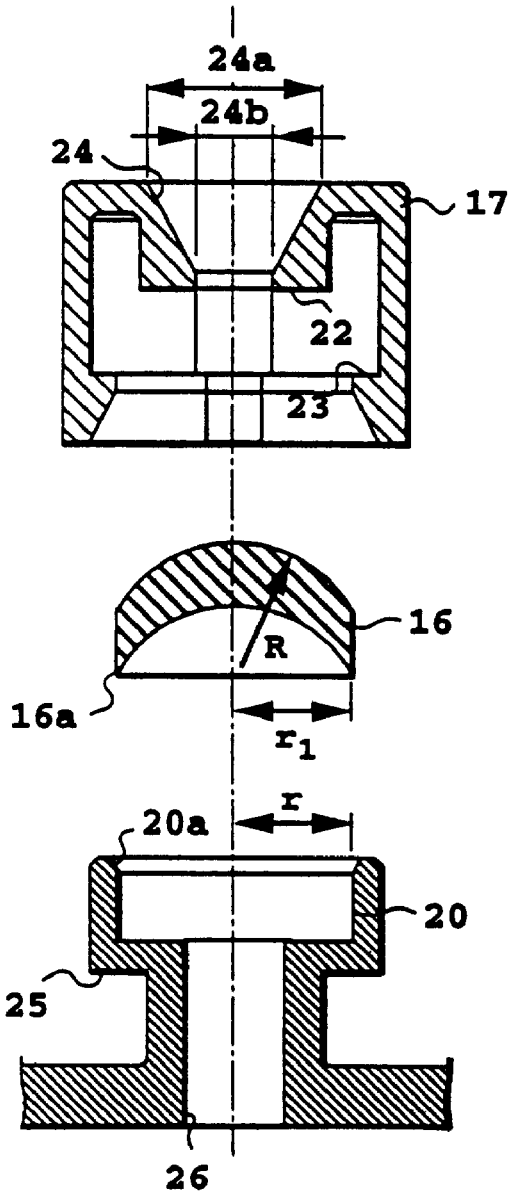
FIG. 13 is a section showing a coupling portion with an ink supply needle or so forth in the foregoing embodiment of the ink tank.

In FIG. 13, the reference numeral 20 denotes the housing set forth above. The internal radius r of the housing 20 as receptacle for the elastic body 16 is substantially equal to the external radius $r_1$ of the elastic body 16. Here, while smaller radius $r_1$ of the elastic body 16 than the internal radius r of the housing 20 may facilitate installation, even when the $r_1$ is slightly greater than r, since the configuration of the elastic body 16 may be easily deformed by applying a force, no significant problem will be arisen as long as the $r_1$ is not excessively greater than r. On the other hand, by chamfering or rounding at the inlet portion 20*a* of the housing or by providing chamfer or rounded edge at the lower side 16*a* of the elastic body 16, assembling of the elastic body 16 into the housing 20 can be facilitated. In addition, by providing chamfering or rounding, bucking of the elastic body 16 or so forth can be successfully prevented. Also, the preliminarily wetting the elastic body by waster (preferably a pure water) or ink solvent, assembling can be further facilitated. As can be clear from the drawings, the elastic body 16 is formed into a dome shaped configuration having a curvature R as a sole body.

The crown body 17 is installed to cover the housing 20. The crown body 17 has an engaging claw 23 engageable with an engaging portion 25 at the side of the housing 20, and a pushing portion 22 for pushing the elastic body 16 in a direction substantially perpendicular to the diametrical direction of the elastic body 16. The reference numeral 24 denotes an opening portion for guiding the needle of the main body. The tip end 24*a* of the opening portion 24 is formed to be greater than the rear end 24*b* so that the needle certainly locate in the vicinity of the center of the elastic body. The reference numeral 26 denotes a communicating portion toward inside of the container.

Figure 14:
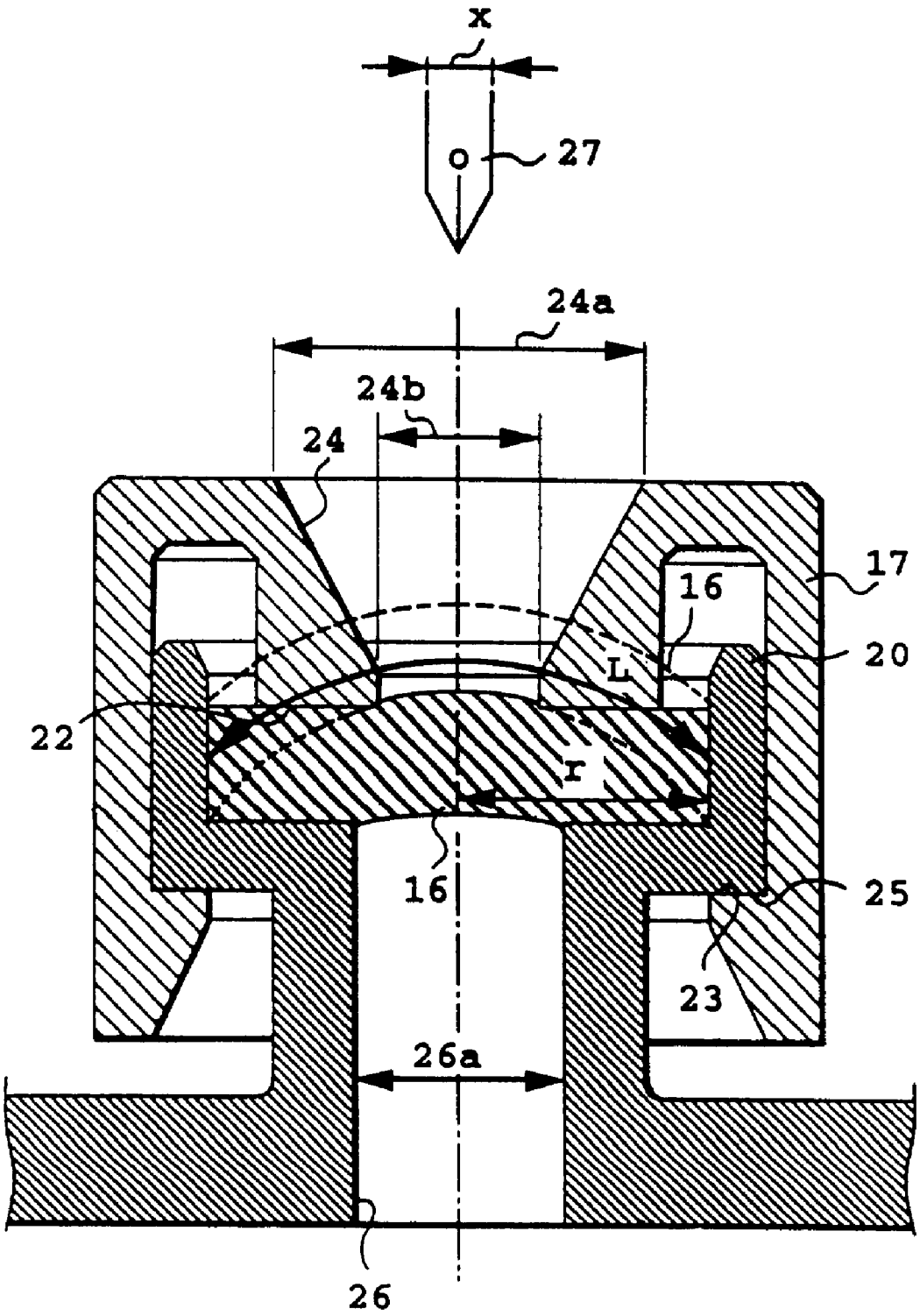
FIG. 14 is an enlarged section of the foregoing engaging portion.
Figure 15A:
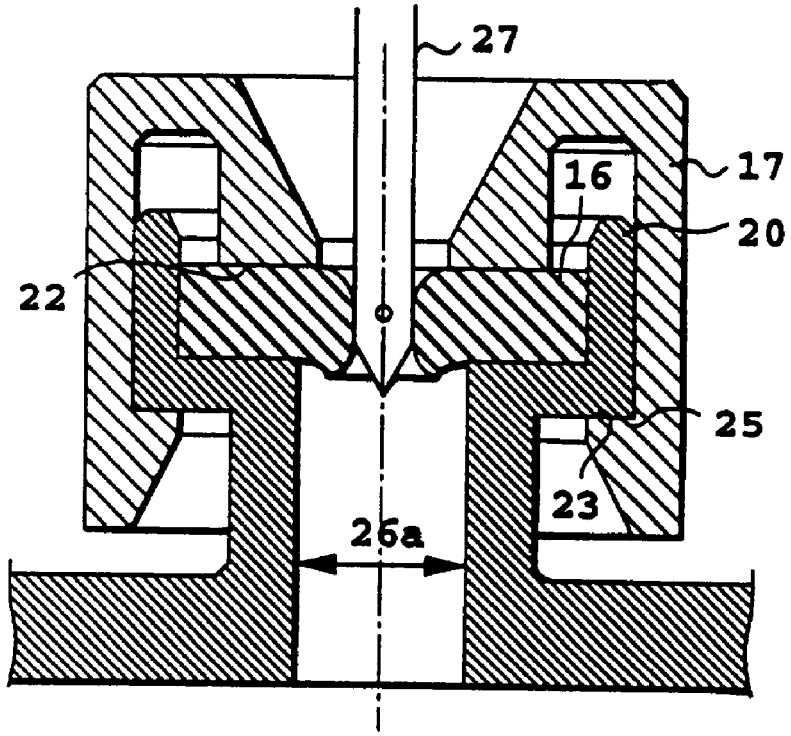
FIGS. 15A and 15B are sections for explaining an appropriate internal diameter in the foregoing coupling portion.
Figure 15B:
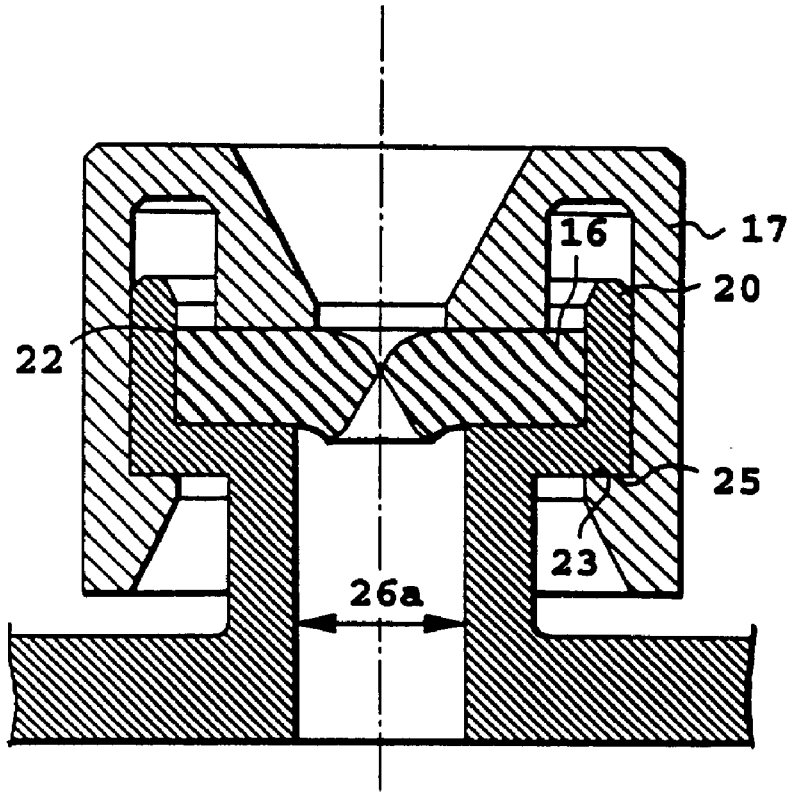

In FIG. 14, there is illustrated a condition where the foregoing three parts are assembled. As can be appreciated from FIG. 14, the elastic body 16 before installation of the crown body 17 is in the condition shown by broken line, whereas the elastic body 16 is depressed by the pushing portion 22 of the crown body 17 in a direction substantially perpendicular to the diametrical direction to be installed within the housing 20 in a form as illustrated by the solid line. At this time, with respect to the internal diameter=2r of the housing 20, the length L in the direction of section of the elastic body 16 in the independent form is 2r<L. Thus, in the condition depressed by the crown body 17, the elastic body 16 tends to expand in the diametrical direction of the housing 20. Since the expanding force is restricted by the housing, the elastic body 16 is held in a condition compressed in the diametrical direction by the housing 20 and the crown body 17. By this, even when the needle 27 is pierced and removed, the elastic body 16 is returned to the initial condition to close the hole formed by piercing of the needle 27. Therefore, leakage of the ink or waste ink as the content can be successfully prevented.

On the other hand, relationship between the opening diameter 24*b* at the. side of the pushing portion 22 of the opening portion 24 of the crown body 17 and the internal diameter 26*a* of the communicating portion 26 at the housing side is 24*b*≦26*a*. In view of depression of the elastic body 16 with the pushing portion 22 of the crown body 17, it is desirable to form the opening diameter 24*b* as small as possible, whereas in relation to the needle 27, it is desirable to make the opening diameter 24*b* as large as possible. Accordingly, when the opening diameter 24*b* is reduced as small as possible, in order to effectively utilize the opening diameter 24*b* sufficiently, in consideration of the position error between the crown body 17 and the housing 20 or so forth, the internal diameter of the communicating portion 26 at the side of the housing 20 is made equal to or greater than that of the elastic body. If the dimensional relationship is opposite, the needle 27 passing the opening portion 24 of the crown body 17 and piercing the elastic body, may abut onto the housing to make further piercing impossible.

On the other hand, when the internal diameter 26*a* of the communicating portion 26 is excessively large, the elastic body 16 may be depressed into the housing when the needle is pierced and may not return to the initial position even after removing of the needle 27. While fluctuating depending upon thickness of the elastic body 16 or size of the needle 27, based on the results of experiments, when the thickness of the elastic body 16 is about 3 mm and the diameter of the needle 27 is 1.2 mm, the internal diameter 26*a* is desirably less than or equal to ϕ5 mm.

Next, with respect to the curve radius R of the elastic body 16, the internal radius r of the housing and the diameter x of the needle 27, piercing and removing ability, and presence or absence of exuding of the content from the elastic body were checked. The results are shown in the following table 1.

It should be noted that, in the table 1, unit of r, R and x is mm, $(R/r)\sin^{-1}(r/R)$ has no dimension, A: good
B: no good in some condition
C: no good

TABLE 1

| | r (mm) | R (mm) | (R/r) $\sin^{-1}$ (r/R) | X (ϕ) | Leak | Pierce |
|---|---|---|---|---|---|---|
| I | 5 | 5 | 1.57 | 0.8 | A | B |
| | | | | 1 | A | C |
| II | 5 | 5.1 | 1.4 | 0.8 | A | A |
| | | | | 1 | A | A |

TABLE 1-continued

| | r (mm) | R (mm) | (R/r) $\sin^{-1}$ (r/R) | X (φ) | Leak | Pierce |
|---|---|---|---|---|---|---|
| | | | | 1.2 | A | B |
| III | 5 | 5.3 | 1.3 | 0.8 | A | A |
| | | | | 1 | A | A |
| | | | | 1.2 | A | A |
| IV | 5 | 5.8 | 1.2 | 0.8 | A | A |
| | | | | 1 | A | A |
| | | | | 1.2 | A | A |
| V | 5 | 6.4 | 1.15 | 0.8 | A | A |
| | | | | 1 | A | A |
| | | | | 1.2 | A | A |
| VI | 5 | 7.3 | 1. 1 | 0.8 | A | A |
| | | | | 1 | A | A |
| | | | | 1.2 | B | A |
| VII | 5 | 10 | 1.05 | 0.8 | B | A |
| | | | | 1 | B | A |
| | | | | 1.2 | C | A |

As can be seen from the foregoing table, in relation to the ink leakage, 1.05>(R/r) $\sin^{-1}$ (r/R) is required, and in relation to needle piercing ability, (R/r) $\sin^{-1}$ (r/R)<1.57 becomes necessary condition. Accordingly, it is desirable to set R and r in a range for satisfying:

$$1.05<(R/r)\sin^{-1}(r/R)<1.57$$

Furthermore, in consideration of the problems in the use condition or so forth, it is desirable to set R and r for satisfying:

$$1.1<(R/r)\sin^{-1}(r/R)<1.4$$

Here, the mark B in evaluation of the ink leakage represents the case where ink leakage is caused after removing the needle when permanent strain is caused in the elastic body 16 by maintaining with piercing the needle 27 under the environment of 60° C. or so forth. On the other hand, the mark B in evaluation of needle piercing ability represents, in consideration of convenience of use, a level to be judged too hard for ladies or those having small power.

On the other hand, the shown embodiment of the ink tank has a construction as shown in FIG. 5, and when the ink in the ink container is consumed out, a needle for ventilating internal air is pierced to one of the coupling portion, and ink is re-filled to the other by means of injector or so forth. Furthermore, by providing new parts of the crown body 17 and the elastic body 16 and exchange with the old ones, completely equivalent performance to the initial condition can be recovered.

In addition, by selecting the material of the waste ink container to be a material which permits to observe the ink absorption amount in the waste ink container in certain extent, e.g. chemically stable material to the ink, such as polyethylene, polypropylene or so forth and thus being difficult to be attached by the ink, and being capable to permit observation of the condition of the ink in the certain extent, accumulation of the waste ink in the excess amount in the waste ink absorbing body by repeating re-filling of the ink to cause overflow from the waste ink container can be successfully prevented.

It should be noted, however, that, even when overflow is caused, the ink may flow toward the coupling portion as set forth above, if the ink sensor as set forth above is provided, it is possible to eliminate possibility using the ink tank in the condition where the waste ink container is filled up with the waste ink and thus is causing overflow.

On the other hand, providing the material having water absorbing ability in the coupling portion side of the main body is desirable in viewpoint of reliability of the overall apparatus.

Figure 16:
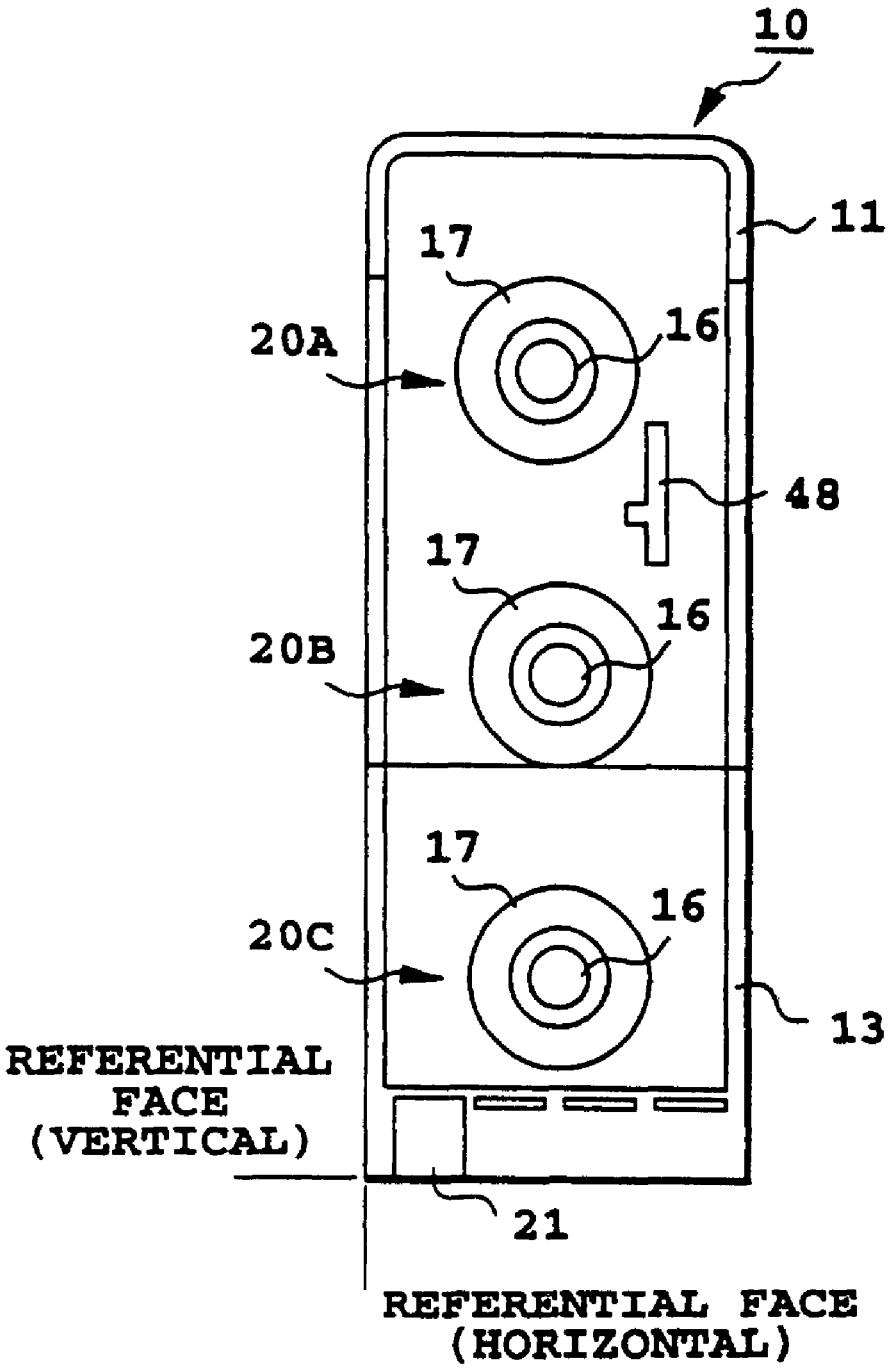
FIG. 16 is a front elevation of an end portion of the ink tank having the foregoing coupling portion.

FIG. 16 is a front elevation of the shown embodiment of the ink cartridge as viewed from the of the coupling portion side.

Respective of the coupling portions 20A, 20B and 20C are respectively provided at predetermined positions from two reference surfaces. These reference surfaces are adapted to contact with predetermined portions when the ink cartridge 10 is loaded in the apparatus main body for enable positioning relative to the supply needle and respective coupling portions of the main body side. With taking the left side surface of FIG. 16 as the reference in the horizontal direction, as can be clear from FIG. 16, only the coupling portion 20A in the uppermost position is provided with offset toward the reference surface side in comparison with other to coupling portions 20B and 20C. A space defined by offset of this coupling portion 20A, a convex portion 48 is formed. The convex portion 48 is formed to have a height substantially equal to the front end face of the ink cartridge (see FIG. 5) and performs the following function.

Figure 17:
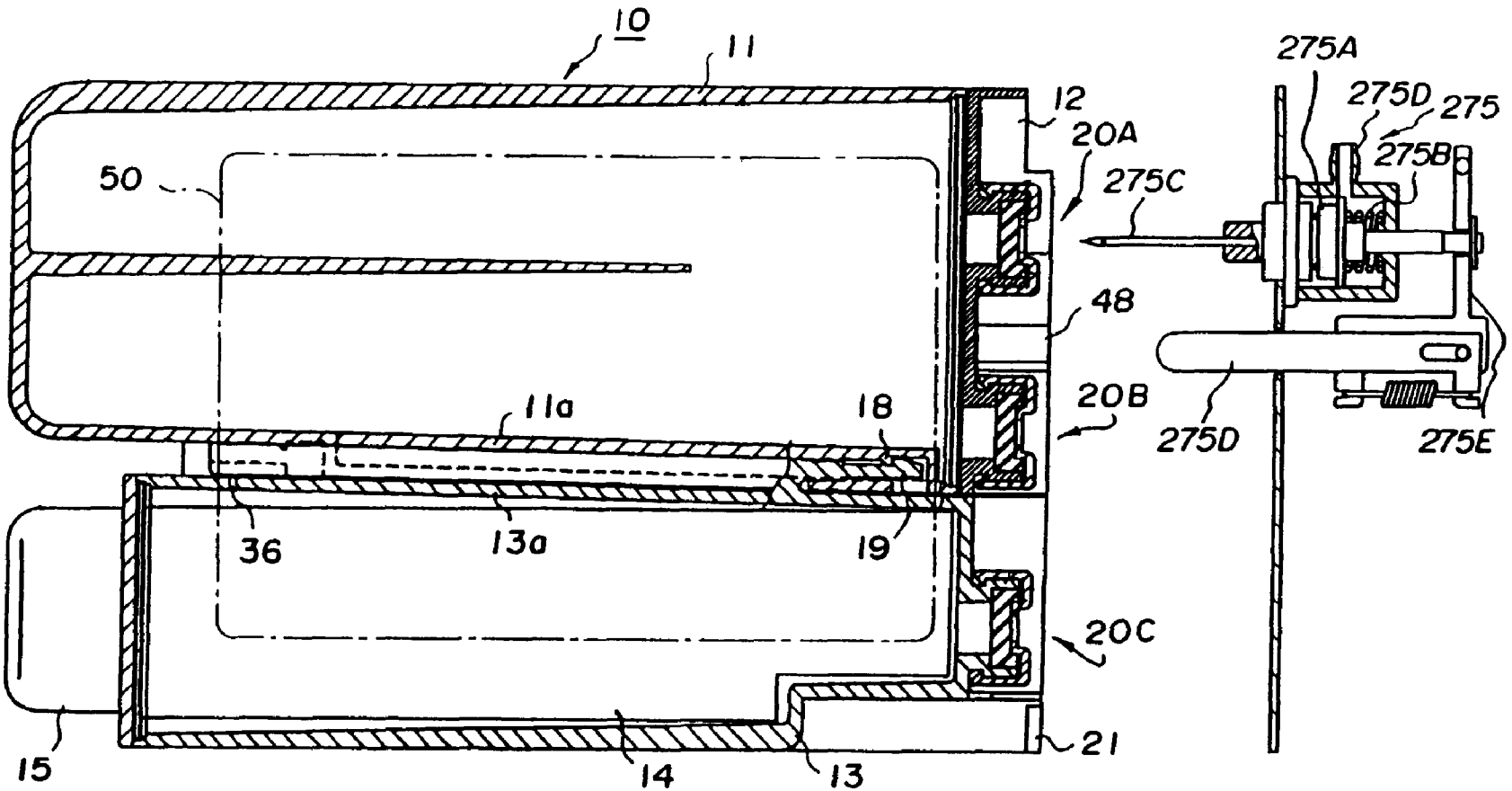
FIG. 17 is a section for explaining connection between the foregoing embodiment of the ink tank and the supply needle.
Figure 18:
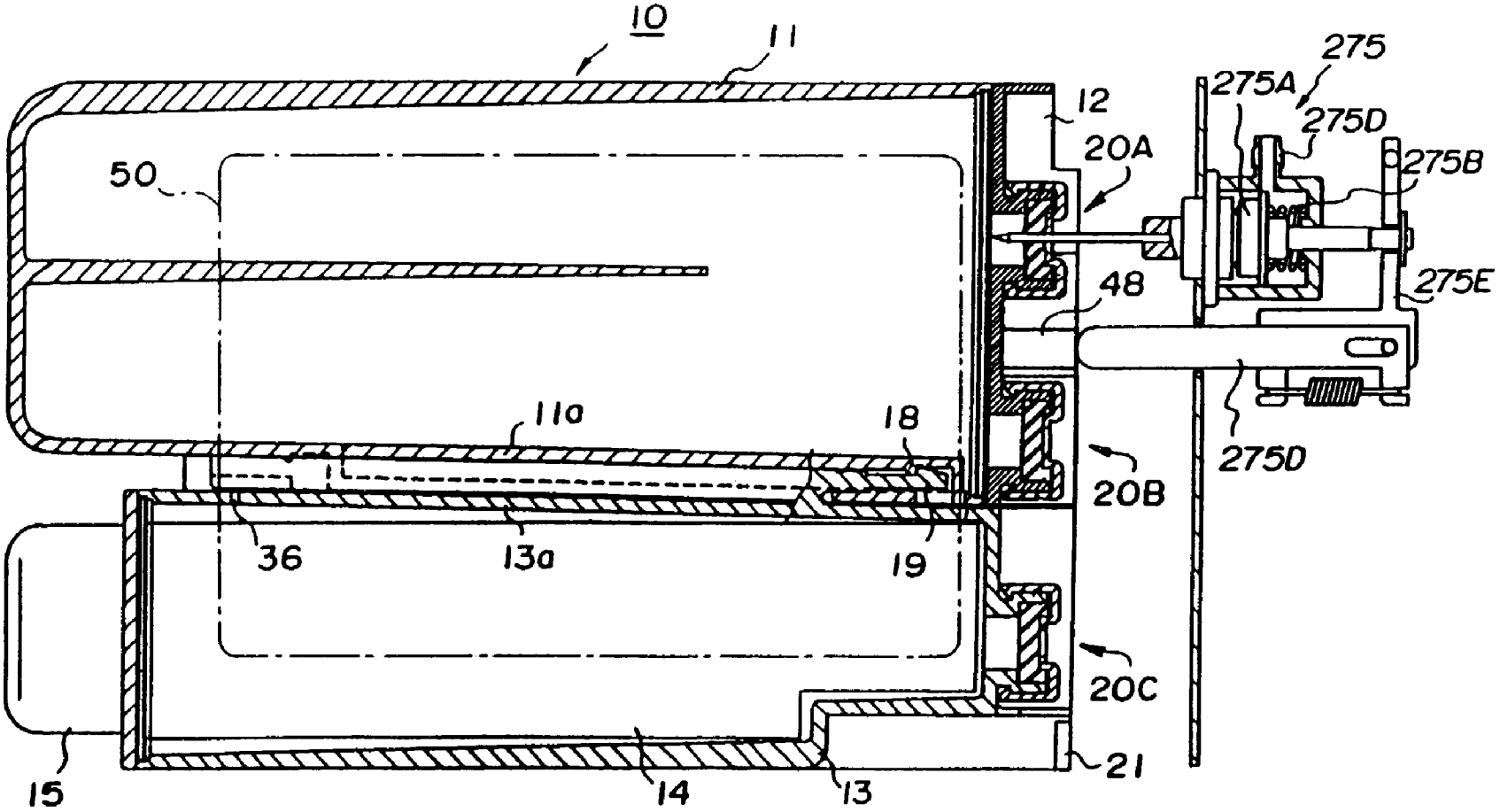
FIG. 18 is a section for explaining connection between the foregoing embodiment of the ink tank and the supply needle.
Figure 19:
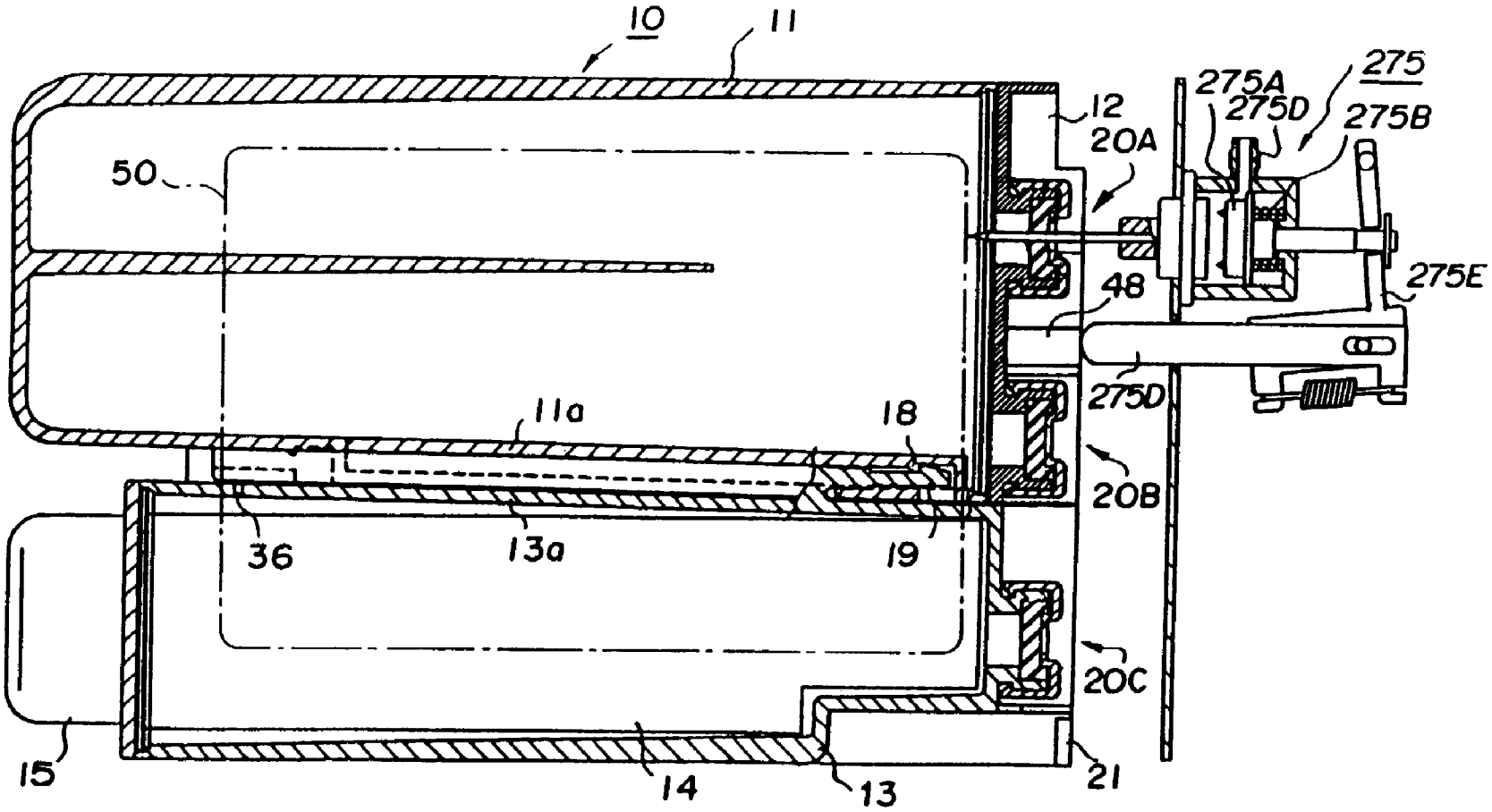
FIG. 19 is a section for explaining connection between the foregoing embodiment of the ink tank and the supply needle.

FIGS. 17 to 19 are illustrations for explaining functions of the convex portion 48 shown in FIGS. 5 and 16 and are sections showing positional relationship of the needle 275C of a supply needle unit 275 and the ink cartridge 10 upon loading.

At first, associating with loading of the ink cartridge, immediately before contacting the elastic body 16 in the ink cartridge 10, since no force will act on a lever 275D, a valve 275A is biased by means of a spring 275B to maintain the communication passage in closed condition.

Next, when insertion of the ink cartridge 10 is further progressed, as shown in FIG. 18, the lever 275D of the supply needle unit 275 reaches to contact with the convex portion 48 of the ink cartridge 10. At this timing, the portion having the communication hole at the tip end of the needle 275C already pieces through the elastic body 16 and is located within the ink cartridge. On the other hand, a this time, the lever 275D is just come into contact with the convex portion 48 of the ink cartridge. In contrast to this, the depression force from the ink cartridge is just about act. Accordingly, at this time, the valve 275A maintains the communication passage in closed condition.

Next, as shown in FIG. 19, when the ink cartridge 10 is further inserted, the depression force from the ink cartridge acts on the lever 275D to depress the latter. By this, a connecting lever 275E is displaced toward right in the drawing about one end serving as fulcrum. As a result, the valve 275A connected to the lever 275E is displaced toward right against the biasing force of the spring 275B to establish communication between the connection pipe 275D and the communication opening of the needle 275C.

As can be clear from the discussion with reference to FIGS. 17 to 19, the supply needle unit 275 for circulating the ink to the ink cartridge from a not shown sub-tank at first enters the portion of the communication opening of the needle 275C into the ink cartridge associating with the insertion operation of the ink cartridge 10. Subsequently, the valve 275A is opened/ In other words, the relationship between the length of the lever 275D and the length of the needle 275C is determined to assure the foregoing series of operation.

With such construction, it can be successfully avoided to open the valve 275A before the needle is inserted into the cartridge to cause leakage of the ink from the sub-tank side via the communication opening of the needle 275C.

As set forth above, the convex portion 48 is provided for valve operation of the supply needle of the apparatus main body side. However, projecting of the convex portion 48 into the recessed portion of the lid 12 of the ink container is for facilitating production of the coupling portions 20A and 20B as set forth above. Namely, in formation of these coupling portions, the elastic body 16 is mounted in the housing 20, and the crown body 17 is further mounted. Mounting operation is facilitated since the surrounding thereof is the space of the recessed portion. Therefore, the convex portion 48 to abut against the lever 275D as set forth above is projected into the recessed portion.

It should be noted that the ink supply needle 275C as set forth above is for returning the ink recirculated from the not shown sub-tank to the ink storage portion of the ink cartridge, and thus passes through the elastic body 16 at the coupling portion 20A. Other coupling portion 20B connects the supply needle for performing ink supply to the apparatus main body. On the other hand, the coupling portion 20C of the waste ink container is designed to connect the needle for introducing the waste ink into the waste ink storage chamber. The needles of the supply needle units connected with the coupling portions 20B and 20C do not have the valve construction as set forth above.

An example of the other coupling portion in the cartridge according to the present invention will be explained as follows:

In this embodiment, assembling ability can be improved comparing with the former embodiment.

Figure 20:
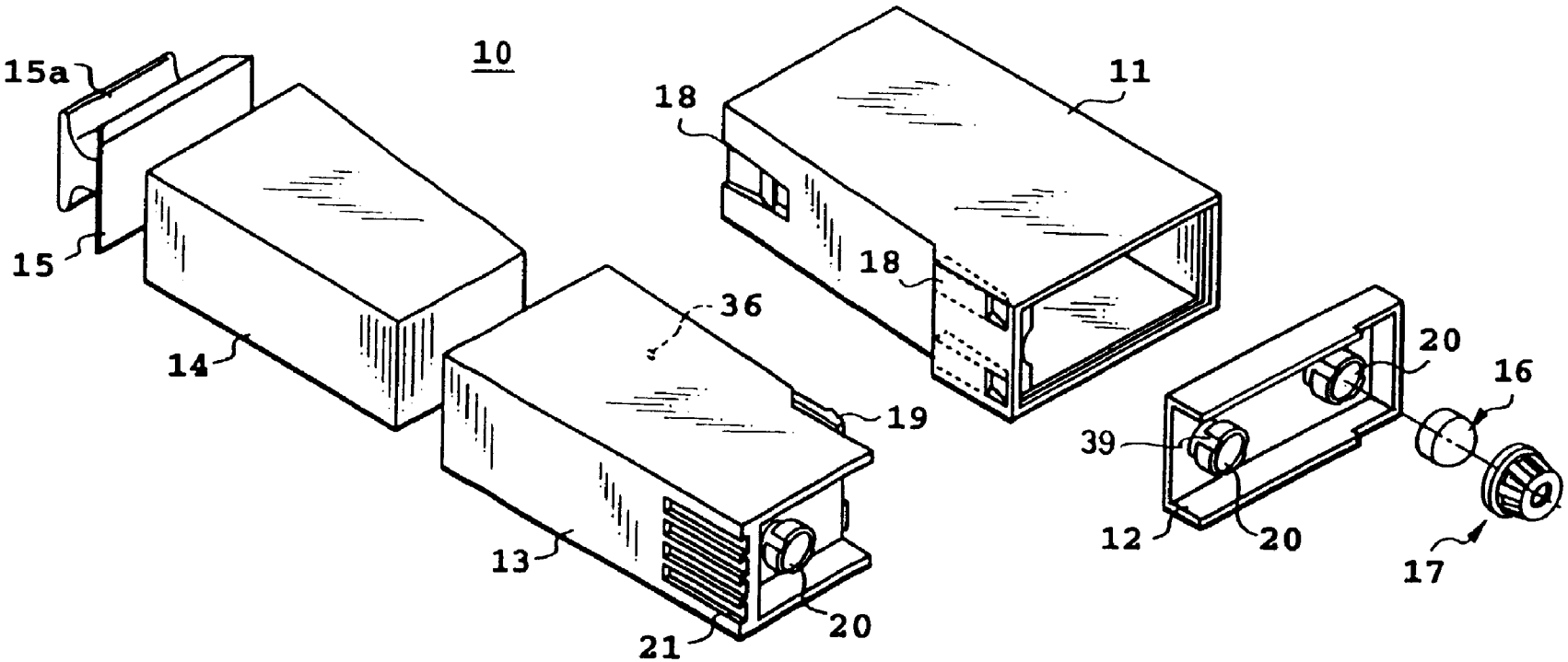
FIG. 20 is an exploded perspective view showing another embodiment of the ink tank according to the present invention.
Figure 21:
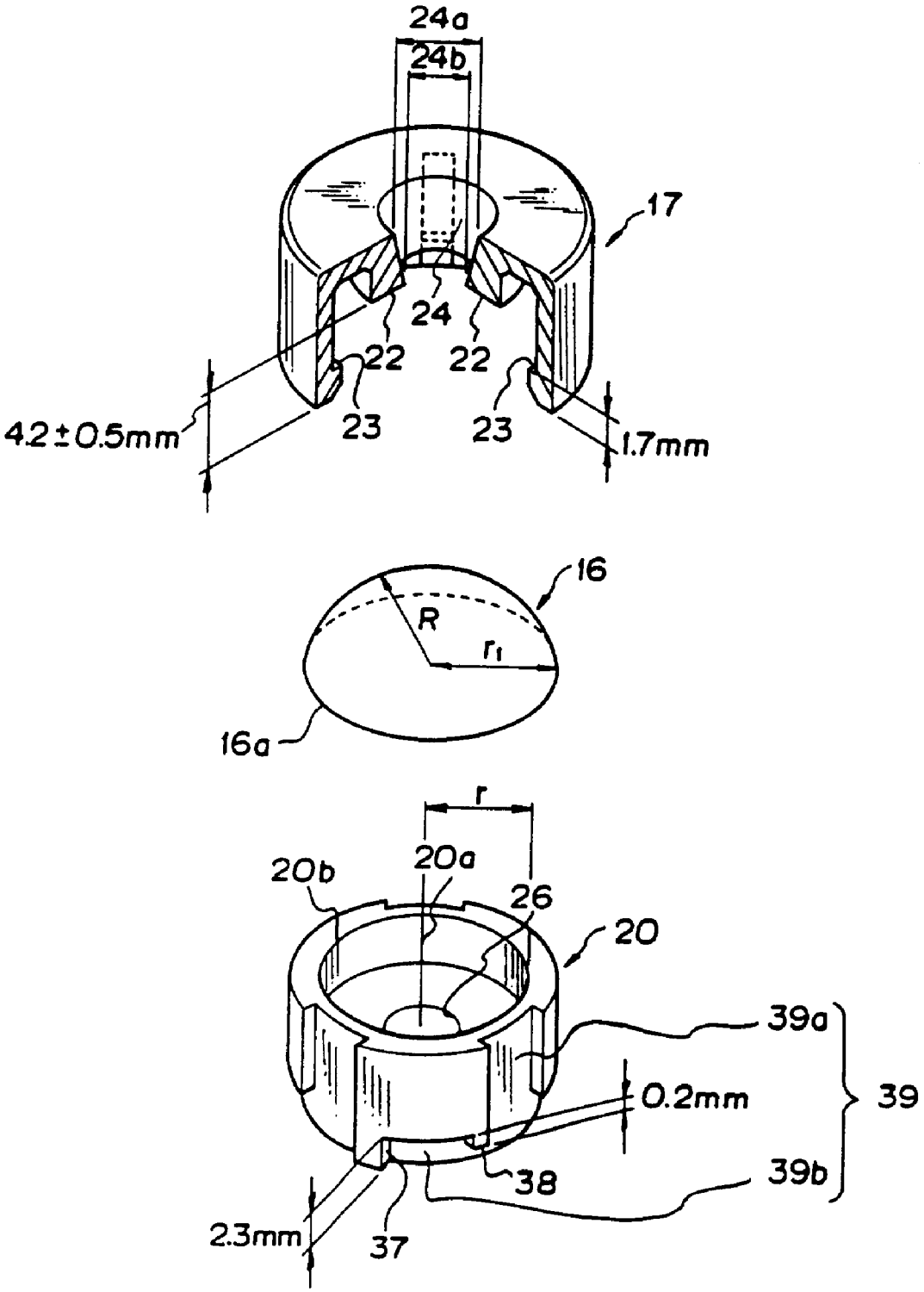
FIG. 21 is a perspective view of respective parts forming the ink coupling portion in the ink tank shown in FIG. 20.

In FIGS. 20 and 21, the reference numeral 20 denotes the cylindrical housing. Within this housing 20, an elastic body receptacle portion 20*a* for receiving therein the elastic body 16. An internal radius r of the elastic body receptacle portion 20*a* and the external radius $r_1$ of the elastic body 16 are set at substantially equal dimensions. Here, it would facilitate assembling when the external radius $r_1$ of the elastic body 16 is smaller than the internal radius r of the elastic body receptacle portion 20*a*. However, conversely, even when $r_1$ is slightly greater than r, since the configuration of the elastic body 16 may be easily varied by externally applying a force. Therefore, no problem will be arisen as long as the $r_1$ is not excessively great. Also, by forming chamber or rounded portion at the side of the inlet 20*b* of the elastic body receptacle portion 20*a*, or by forming the chamfer or rounded portion on the lower surface 16*a* of the elastic body 16, assembling ability can be improved. In addition, possibility of causing buckling of the elastic body can be reduced. Also, by wetting the elastic body 16 with water as a component of the ink (preferably pure waster) or the ink solvent may be further effective for facilitating assembling. The elastic body 16 is in dome shaped configuration having curvature R as independent body, as can be clear from FIG. 21.

On the outer periphery portion of the housing 20, the crown body 17 as fixing member may be engaged and fixed. The crown body 17 is substantially cylindrical configuration and has a plurality of (two out of three are illustrated in FIG. 21) claw portions 23. Corresponding to these claw portions 23, grooves 39 serving as engaging portion for guiding the claw portions 23 and engaging therewith are provided on the outer periphery portion of the housing 20. The groove 39 generally comprises a first groove portion 39*a* downwardly extending from the upper end of the outer periphery portion of the housing 20 along the axis of the housing 20, and a second groove portion 39*b* extending in circumferential direction from the lower portion of the first groove portion 39*a*. At the front end portion of the second groove portion 39*b*, a stopper portion 37 is provided for preventing overrunning in rotation of the crown body 17. Also, on the upper edge portion of the second groove portion 39*b*, projection type engaging portion 38 is provided for preventing the claw portion 23 from returning toward the first groove portion 39*a*. On the other hand, within the crown body 17, the pushing portion 22 for depressing the elastic body 16 housed within the elastic body receptacle portion 20*a* of the housing to close the cylindrical hole 26, is provided at inner side of the claw portions 23 and higher position than the claw portions.

Here, installation of the crown body 17 to the housing 20 will be discussed.

At first, after receiving the dome shaped elastic body 16 within the elastic body receptacle portion 20*a* of the housing 20. Then, a plurality of claw portions 23 of the crown body 17 is positioned relative to the first groove portions 39*a*.

Then, by depressing the crown body 17 downwardly along the axis of the housing 20, the elastic body 16 is elastically deformed by depression in the direction substantially perpendicular to the diametrical direction of the elastic body 16. When the claw portions 23 of the crown body 17 reaches the lower ends of the first groove portions 39*a*, the crown body 17 is rotated in circumferential direction of the housing 20 (clockwise direction in FIG. 21) until abutting against the stopper portion 37. By this, the claw portions 23 is guided into the second groove portions 39*b* beyond the engaging portion 38. At this time, even when the depression force onto the crown body 17 is released, the claw portions 23 are upwardly urged onto the upper edge portions of the second groove body 39*b* by the restoring force of the elastically deformed elastic body 16.

It should be noted that the pushing portion 22 of the crown body 17 and the elastic body 16 are in contact with each other with in slidable state at low friction. Therefore, torsional force may not be created in the elastic body 16 by rotation of the crown body 17. Thus, an elastic component of the elastic restoration force along the direction of the second groove portion 39*b* due to torsional force exerted, is small, engagement of the upper edge portion of the second groove portion 39*b* to the claw portion 23 may not be released by the restoring force of the elastic body 16. In order to more certainly prevent releasing of engagement, in the shown embodiment, the claw portion 23 engages with the engaging portion 38 of the second groove portion 39*b* to complete installation of the crown body 17 to the housing 20.

After completion of installation as set forth above, the claw portion 23 of the crown body 17 set forth above is biased upwardly toward the upper edge portion of the second groove portion 39*b* so as not to pass over the projection form engaging portion 38. Thus, the crown body 17 may not drop out from the housing 20 by vibration, impact of dropping, environmental condition, such as heat cycle or so forth. Therefore, closure of the cylindrical hole 26 of the ink tank by the elastic body 16 in the housing 20 may not be released easily. Accordingly, in the shown embodiment, the ink tank having high reliability can be provided without any ink leakage. On the other hand, no force in the direction for expanding the diameter may be applied to the crown body 17. Therefore, even when non-expandable material of the crown body 17 and high rigidity material of the housing 20 are combined, assembling is easy. Also, without applying significant stress on the crown body, a coupling portion having high reliability can be provided.

In FIG. 21, the reference numeral 24 denotes an opening portion for guiding the needle of the main body. The tip end 24*a* is formed wider than the rear end 24*b* so that the needle may certainly be positioned substantially at the center of the elastic body with respect to position error to the needle of the main body side. At the lower side of the opening portion 24, the foregoing pushing portion 22 is formed. On the other hand, in the drawing, the reference numeral 26 denotes a communicating portion (cylindrical hole) formed at the center portion of the elastic body receptacle portion 20*a* of the housing for establishing communication with the interior of the container.

It should be noted that, in FIG. 21, a distance from the surface of the ink container to the upper edge portion of the second groove portion 39*b* of the housing is set at 2.3 mm, for example. The height of the claw portion 23 of the crown body 17 is 1.7 mm, for example. In this case, maximum depression amount of the crown body 17 into the housing 20 becomes about 0.6 mm. At this time, assuming that a projecting amount of the engaging portion 38 of the housing 20 is 0.2 mm, for example, approximately 0.4 mm of gap is formed between the claw portion 23 and the engaging portion 38 at the maximum depression amount.

In this embodiment, it is needless to say that the coupling portion preferably satisfies the similar condition to the former embodiment.

Figure 22:
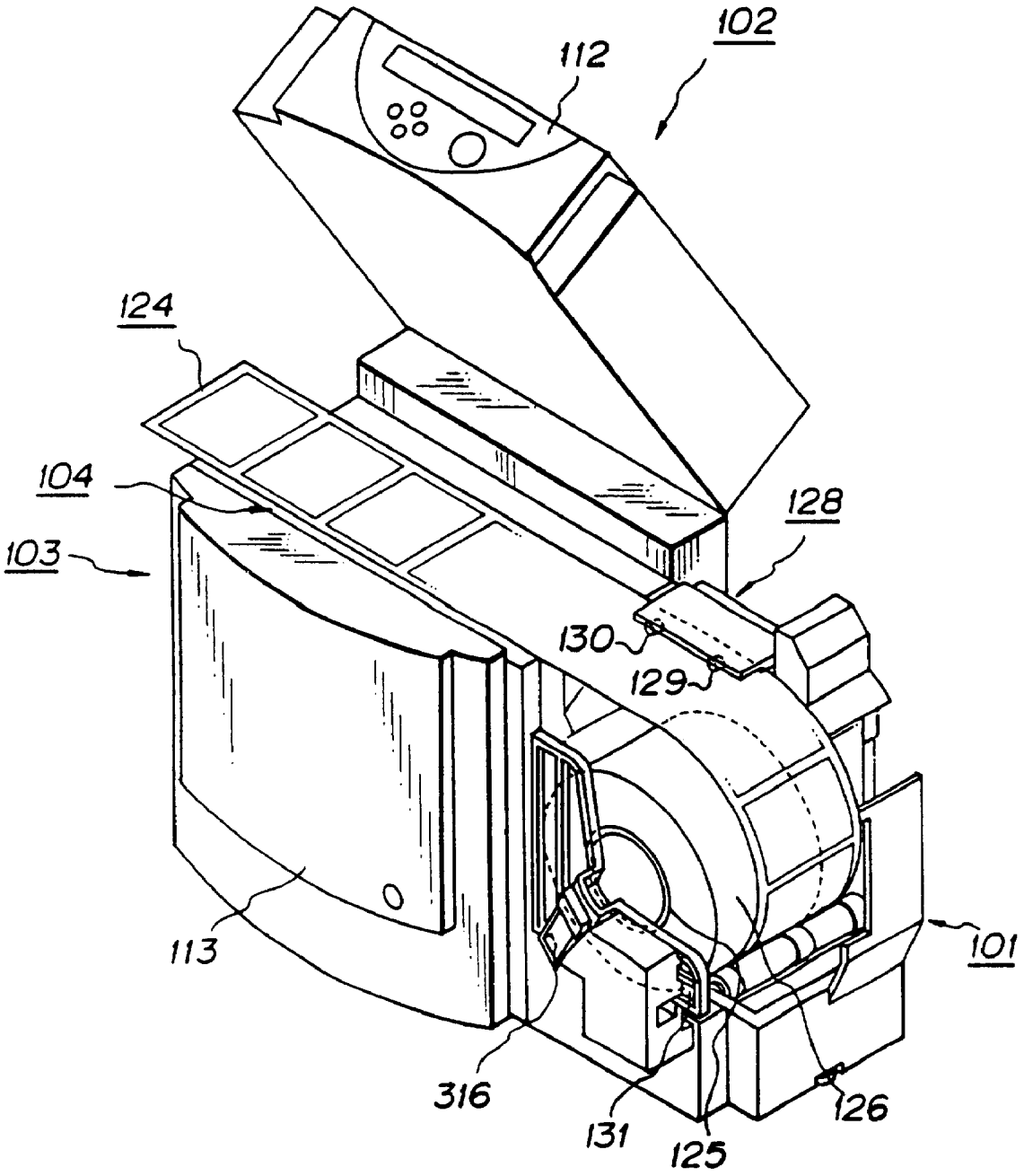
FIG. 22 is a perspective view showing a label printer having the ink tank, to which the present invention is applied.
Figure 23:
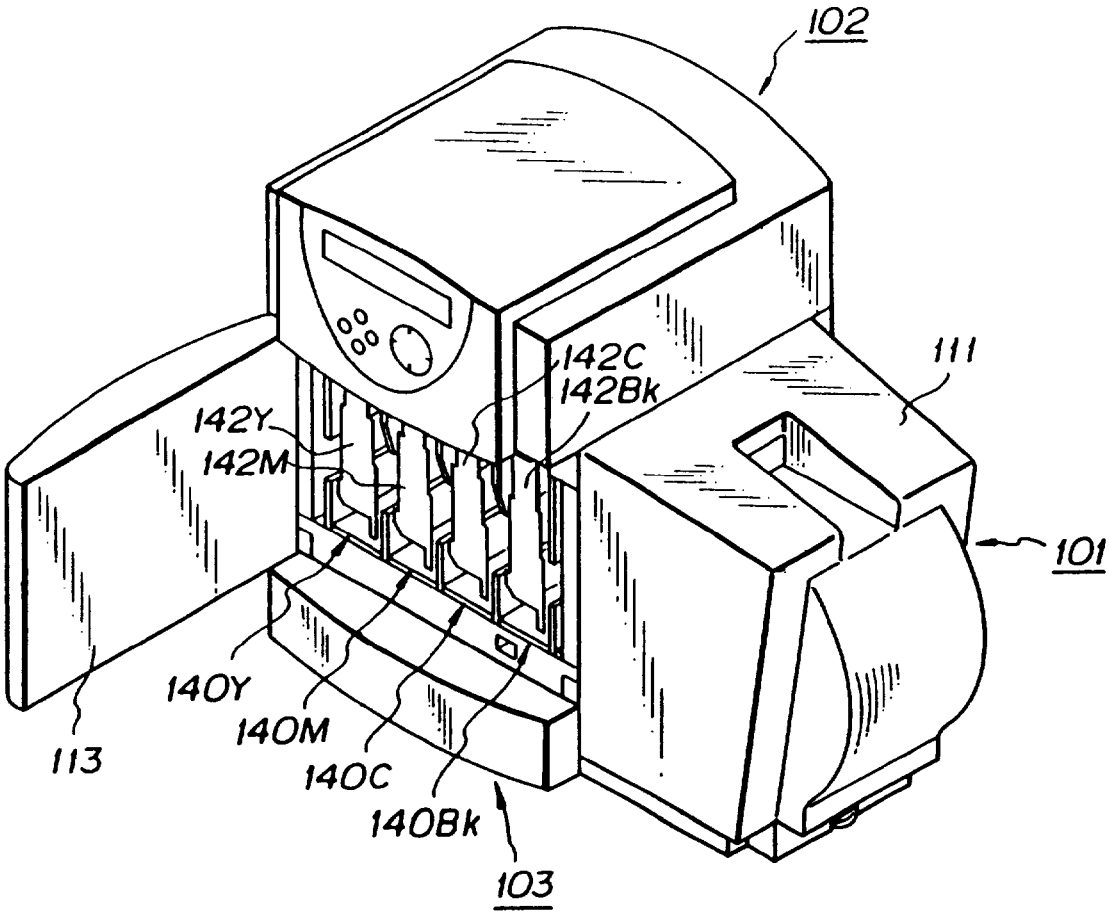
FIG. 23 is a perspective view of the printer as viewed from the front side.

FIG. 22 is a perspective view of a label printer as an ink-jet printing apparatus, to which the present invention is applied, in a condition where a cover 111 of a roll paper supply unit 101 is removed and a printing head 102 is opened by pivoting upwardly, and FIG. 23 is a perspective view showing a condition where a front cover 113 of an ink cartridge portion 103 is opened.

As shown in FIG. 22, a roll 126, on which a roll paper 124 to be housed within the roll paper supply unit 101 is wound around, is mounted on two driving rollers 301 (one is not shown) provided on the bottom portion of the unit 101. The outer periphery side of the roll 126 and driving roller 301 are held in contact associated with depression force by own weight of the roll paper 124. In this condition, by rotating the driving roller 301 or so forth by driving force of not shown motor, the roll paper 124 at the outermost periphery is fed separating from the roll paper at the inside. Feeding of the roll paper is performed substantially irrespective of transportation by a roll paper feeding mechanism 104 (detail thereof is not shown) between a printer head portion 102 and a cartridge receptacle portion 103. Accordingly, in order to adjust feeding between two portions, in the foregoing roll paper supply, feeding of the roll paper is controlled to form a loop (slack, not shown in FIG. 22) serving as a buffer. Namely, when a loop sensor (not shown) fails to detect a loop by feeding in the feeding mechanism 104, the foregoing driving roller is driven to perform feeding of the roll paper with forming the loop.

The paper guide 131 is provided for sliding in the width direction of the stored roll 126. Namely, upon storing the roll paper, the paper guide 131 is slide in a magnitude greater than the width of the roll paper 124 to mount the roll 126 on the driving roll. Thereafter, the paper guide 131 is slide to the width of the roll 126 to abut a part onto the core member 125 of the roll 126. By this, upon supplying the roll paper 124, vibration of the roll paper 124 in the width direction at the upstream side of the driving roll in the feeding direction can be restricted with permitting a given fine vibration. It should be noted that, in the paper guide 131, a stopper 316 for fixing the slide position of the paper guide is provided.

In the roll paper feeding path, in the vicinity of the inlet of the feeding path by the feeding mechanism 104, an obliquely feeding unit 128 is provided. The obliquely feeding unit 128 includes two obliquely feeding rollers (not shown) contacting with the lower surface of the roll paper 124 and obliquely feeding rolls 129 and 130 opposing to the obliquely feeding rollers and contacting with the upper surface of the roll paper 124. Two obliquely feeding rollers comprises driving roller opposes with the obliquely feeding roll 130 and is driven by driving force from the side of the feeding mechanism, and a driven roller opposing to the obliquely feeding roll 129 and is not positively driven. Respective rollers are mounted for rotation in a direction oblique to the feeding direction of the roll paper (rotation shaft lies oblique to the direction perpendicular to the feeding direction). On the other hand, the obliquely feeding rolls 129 and 130 are also mounted in oblique relative to the feeding direction similarly to the obliquely feeding rollers. It is possible that by these obliquely feeding rollers and the obliquely feeding rolls 129 and 130, a feeding force in oblique direction is applied to the roll paper to be fed to depress onto predetermined guide at the back side in the drawing. As a result, since the roll paper 124 is fed with restriction of the feeding direction to the predetermined direction, good performance in feeding can be obtained without causing deflection of the feeding direction.

The roll paper feeding mechanism 104 provided between the printing head portion 102 and the cartridge receptacle portion 103 is neglected from illustration in FIG. 23. The roll paper feeding mechanism 104 is constructed with a plurality of belts arranged lower side of the roll paper 124 in the drawing (accordingly arranged at upper surface of the cartridge receptacle portion 103), rollers provided at upstream side and downstream side in the feeding direction for driving the belts, and spur arranged on lower surface of the printing head portion 102 and driven by a predetermined belt among a plurality of belts.

In FIG. 23, the ink cartridge receptacle portion 103 has four cartridge receptacle chambers 140Y, 140M, 140C and 14OBk corresponding to four kinds of inks of yellow (Y), magenta (M), cyan (C) and black (Bk) employed in the shown embodiment of the label printer. In the vicinity of the inlet of respective cartridge receptacle chamber, shutters 142Y, 142M, 142C and 142Bk for substantially shielding the inside of the receptacle chambers are provided. These shutters are pivotally supported at the upper portion so as to prevent the user from erroneously inserting hand inside of the receptacle chamber and contacting with the ink supply needle. Upon insertion of the ink cartridge, by pushing the shutter toward the back side of the receptacle chamber by the cartridge per se to perform insertion.

As can be clear from the discussion given hereinabove, with the present invention, even when the ink flows out through the atmosphere communication hole of the waste ink container, the flown out ink is guided to the predetermined position through guide passage defined by the member for coupling the ink container and the waste ink container.

As a result, in the ink tank, in which the ink container and the waste ink container are formed separately and these containers are coupled, stain by unnecessary ink is avoided to provide highly reliable ink tank.

On the other hand, according to the present invention, the ink tank of low cost and stable performance can be easily supplied without requiring any expensive apparatus.

Also, according to the present invention, since assembling of the elastic body is easy, it is possible to assemble even after filing of the ink to increase freedom in setting of the process steps. Furthermore, damaging of the elastic body by the injection needle upon injection of the ink can be resolved to improve reliability. On the other hand, since no force for expanding diameter will be exerted on the crown body, even in the combination wherein the crown body is formed with a non-expandable material and the housing is formed with high rigidity material, assembling can be done easily, and highly reliable coupling portion can be provided without causing significant stress in the crown body.

Furthermore, according to the present invention, it is possible to provide the ink tank which has good needle piercing and releasing property and to certainly close after removing of the needle.

The present invention has been described in detail with respect to preferred embodiments, and it will now be that changes and modifications may be made without departing from the invention in its broader aspect, and it is the invention, therefore, in the appended claims to cover all such changes and modifications as fall within the true spirit of the invention.

What is claimed is:

1. An ink tank for storing an ink to be used in a printing apparatus and an ink used in the printing apparatus, comprising:

an ink container storing the ink to be used in said printing apparatus;

a waste ink container storing the ink used in said printing apparatus;

an atmosphere communication hole provided in said waste ink container; and an ink tank coupling member provided on one of or both of said ink container and said waste ink container for coupling said ink container and said waste ink container, wherein said ink tank coupling member forms an ink guide path for guiding ink flowed from said atmosphere communication hole to a predetermined position of said ink container or said waste ink container.

2. An ink tank as claimed in claim 1, wherein said ink guide path is formed by a guide surface of said ink tank coupling member.

3. An ink tank as claimed in claim 1, wherein said ink guide path is formed by a groove formed on a guide surface of said ink tank coupling member.

4. An ink tank as claimed in claim 1, further comprising a label pasted over both of said ink container and said waste ink container to form said ink guide path.

5. An ink tank as claimed in claim 1, wherein said ink tank coupling member has an engaging recess portion, an engaging snap portion engaged with said recessed portion by elastic deformation, and a spring portion biasing said engaging snap portion in a direction for fixing engagement with said recessed portion.

6. An ink tank as claimed in claim 5, wherein said snap portion includes engaging claws respectively engaging with said engaging recess portion and said spring portion.

7. An ink tank as claimed in claim 1, further comprising a printing apparatus coupling member for coupling said ink tank and said printing apparatus.

8. An ink tank as claimed in claim 1, wherein an ink is filled in said ink container.

9. An ink-jet printing apparatus for performing printing on a printing medium employing an ink-jet head, said printing apparatus having an ink tank for storing an ink to be used in the printing apparatus and an ink used in the printing apparatus, said ink tank comprising:

an ink container storing the ink to be used in said printing apparatus;

a waste ink container storing the ink used in said printing apparatus;

an atmosphere communication hole provided in said waste ink container; and an ink tank coupling member provided on one of or both of said ink container and said waste ink container for coupling said ink container and said waste ink container, wherein said ink tank coupling member forms an ink guide path for guiding ink flowed from said atmosphere communication hole to a predetermined position of said ink container or said waste ink container.

10. An ink tank, comprising:

an ink container storing an ink employed in a printing apparatus;

a cylindrical portion provided in a portion of said ink container, said cylindrical portion having a first engaging portion and an opening portion for inserting a needle body for supplying the ink to said printing apparatus, thereby enabling the supply of ink;

an elastic body closing said cylindrical portion, said elastic body for having said needle body pierce therethrough; and a fixing member having a second engaging portion for engaging said first engaging portion of said cylindrical portion and having an opening portion for passing said needle body, and adapted for directly clamping and pushing said elastic body in collaboration with said cylindrical portion to close said opening portion of said cylindrical portion by said elastic body, said fixing member compression-attaching said elastic body to said cylindrical portion, wherein said elastic body has a dome-shaped configuration having a cylindrical diameter substantially equal to an internal diameter of said cylindrical portion, and wherein an engaging state between said first engaging portion of said cylindrical portion and said second engaging portion of said fixing member is ensured by a restoring force of said elastically deformed elastic body.

11. An ink tank, comprising:

a waste ink container for storing an ink used in a printing apparatus;

a cylindrical portion provided in said waste ink container, said cylindrical portion having a first engaging portion and an opening portion for inserting a needle body for recovering waste ink discharged by said printing apparatus, thereby enabling the recovery of the waste ink;

an elastic body closing said cylindrical portion, said elastic body for having said needle body pierce therethrough; and a fixing member having a second engaging portion for engaging said first engaging portion of said cylindrical portion and having an opening portion for passing said needle body, and adapted for directly clamping and pushing said elastic body in collaboration with said cylindrical portion to maintain closure of said cylindrical portion by said elastic body, said fixing member compression-attaching said elastic body to said cylindrical portion, wherein said elastic body has a dome-shaped configuration having a cylindrical diameter substantially equal to an internal diameter of said cylindrical portion, and wherein an engaging state between said first engaging portion of said cylindrical portion and said second engaging portion of said fixing member is ensured by a restoring force of said elastically deformed elastic body.

12. An ink tank, comprising:

an ink container storing an ink employed in a printing apparatus;

a waste ink container for storing waste ink used in said printing apparatus;

a first cylindrical portion provided in a portion of said ink container, said first cylindrical portion having a first engaging portion and an opening portion for inserting a needle body for supplying the ink to said printing apparatus, thereby enabling the supply of ink;

a second cylindrical portion provided in said waste ink container, said second cylindrical portion having a first engaging portion and an opening portion for inserting a needle body for recovering waste ink discharged by said printing apparatus, thereby enabling the recovery of waste ink;

a first elastic body closing said opening portion of said first cylindrical portion;

a second elastic body closing said opening portion of said second cylindrical portion; and a first and a second fixing member each having a second engaging portion for engaging said first engaginq portion of said first and said second cylindrical portions and having an opening portion for passing said needle body, and said first and said second fixing members being adapted for directly clamping and pushing said first and said second elastic bodies in collaboration with said first and said second cylindrical portions to maintain closure of said first and said second cylindrical portions by said first and said second elastic bodies, said first and said second fixing members compression-attaching said first and said second elastic bodies to said first and said second cylindrical portions, wherein said first and said second elastic bodies each have a dome-shaped configuration and each have a cylindrical diameter substantially equal to an internal diameter of said first and said second cylindrical portions, and wherein an engaging state between said first engaging portion of said first and said second cylindrical portions and said second engaging portion of said first and said second fixing members is ensured by a restoring force of said elastically deformed first and second elastic bodies.

13. An ink tank as claimed in claim 12, further comprising a first housing portion coaxial with said first cylindrical portion and a second housing portion coaxial with said second cylindrical portion, wherein each of said first and said second housing portions have an internal diameter greater than said first and said second cylindrical portions, respectively, said first and said second elastic bodies each have a cylindrical diameter substantially equal to the internal diameters of said first and said second housing portions, respectively, and said first and said second elastic bodies are received within said first and said second housing portions, respectively.

14. An ink tank as claimed in claim 13, wherein said fixing member further comprises a first pushing portion and a second pushing portion for elastically deforming said first and said second elastic bodies within said first and said second housing portions, respectively.

15. An ink tank as claimed in claim 14, wherein, in a case that an internal diameter of each of said first and said second housings is r and a spherical radius of each of said first and said second elastic bodies in a non-deformed condition is R, $1.05<(R/r)\sin^{-1}(r/R)<1.57$ is satisfied.

16. An ink tank as claimed in claim 14, wherein, in a case that an internal diameter of each of said first and said second housings is r and a spherical radius of each of said first and said second elastic bodies in a non-deformed condition is R, $1.1<(R/r)\sin^{-1}(r/R)<1.4$ is satisfied.

17. An ink tank as claimed in claim 13, wherein a plurality of fixing members are employed, a first fixing member maintaining closure of said first cylindrical portion by said first elastic body, and a second fixing member maintaining closure of said second cylindrical portion by said second elastic body.

18. An ink tank as claimed in claim 17, wherein said first fixing member and said second fixing member further comprise a pushing portion elastically deforming said first and said second elastic bodies within said first and said second housing portions, respectively.

19. An ink tank as claimed in claim 18, wherein, in a case that an internal radius of said first and said second housings is r and a spherical radius of said first and said second elastic bodies in a non-deformed condition is R, $1.05<(R/r)\sin^{-1}(r/R)<1.57$ is satisfied.

20. An ink tank as claimed in claim 18, wherein, in a case that an internal radius of said first and said second housings is r and a spherical radius of said first and said second elastic bodies in a non-deformed condition is R, $1.1<(R/r)\sin^{-1}(r/R)<1.4$ is satisfied.

21. An ink tank as claimed is claim 12, wherein an ink is filled in said ink container.

22. An ink-jet printing apparatus for performing printing on a printing medium employing an ink-jet head, comprising:

an ink supply system comprising:

an ink container storing an ink employed in said printing apparatus;

a cylindrical portion provided in a portion of said ink container, said cylindrical portion having a first engaging portion and an opening portion for inserting a needle body for supplying the ink to said printing apparatus, thereby enabling the supply of ink;

an elastic body closing said cylindrical portion, said elastic body having said needle body pierced therethrough; and a fixing member having a second engaging portion for engaging the first engaging portion of said cylindrical portion and having an opening portion for passing said needle body, and adapted for directly clamping and pushing said elastic body in collaboration with said cylindrical portion to close said opening portion of said cylindrical portion by said elastic body, said fixing member compression-attaching said elastic body to said cylindrical portion, wherein said elastic body has a dome-shaped configuration having a cylindrical diameter substantially equal to an internal diameter of said cylindrical portion, and wherein an engaging state between said first engaging portion of said cylindrical portion and said second engaging portion of said fixing member is ensured by a restoring force of said elastically deformed elastic body.

23. An ink-jet printing apparatus for performing printing on a printing medium employing an ink-jet head, comprising:

an ink supply system comprising:

a waste ink container for storing a waste ink discharged from the printing apparatus in a recovery operation of said ink-jet head;

a cylindrical portion provided in said waste ink container, said cylindrical portion having a first engaging port ion and an opening portion for inserting a needle body for recovering the waste ink discharged by said printing apparatus, thereby enabling the recovery of waste ink;

an elastic body closing said cylindrical portion, said elastic body for having said needle body pierce therethrough; and a fixing member having a second engaging portion for engaging said first engaging portion of said cylindrical portion and having an opening portion for passing said needle body, and adapted for directly clamping and pushing said elastic body in collaboration with said cylindrical portion to maintain closure of said cylindrical portion by said elastic body, said fixing member compression-attaching said elastic body to said cylindrical portion, wherein said elastic body has a dome-shaped configuration having a cylindrical diameter substantially equal to an internal diameter of said cylindrical portion, and wherein an engaging state between said first engaging portion of said cylindrical portion and said second engaging portion of said fixing member is ensured by a restoring force of said elastically deformed elastic bode.

24. An ink-jet printing apparatus for performing printing on a printing medium employing an ink-jet head, comprising:

an ink supply system comprising:

an ink container storing an ink employed in said printing apparatus;

a waste ink container couplable to said ink container, said waste ink container for storing a waste ink discharged from said printing apparatus by a recovery operation of said ink-jet head;

a first cylindrical portion provided in a portion of said ink container, said first cylindrical portion having a first engaging portion and an opening portion for inserting a needle body for supplying the ink to said printing apparatus, thereby enabling the supply of ink;

a second cylindrical portion provided in said waste ink container, said second cylindrical having a first engaging portion and having an opening portion for inserting a needle body for recovering the waste ink discharged by said printing apparatus, thereby enabling the recovery of waste ink;

a first elastic body closing said opening portion of said first cylindrical portion;

a second elastic body closing said opening portion of said second cylindrical portion;

a first and a second fixing member each having a second engaging portion for engaging said first engaging portion of said first and said second cylindrical portions and having an opening portion for accepting said needle body, and said first and said second fixing members being adapted for directly clamping and pushing said first and said second elastic bodies in collaboration with said first and said second cylindrical portions to maintain closure of said first and said second cylindrical portions by said first and second elastic bodies, said first and said second fixing members compression-attaching said first and said second elastic bodies to said first and said second cylindrical portions;

an ink supply means having a first needle body piercing said first elastic body for supplying ink stored in the ink container to said printing apparatus; and a waste ink supply means having a second needle body piercing said second elastic body for supplying the waste ink to said waste ink container, wherein said first and said second elastic bodies each have a dome-shaped configuration having a cylindrical diameter substantially equal to an internal diameter of each of said first and said second cylindrical portions, respectively. and wherein an engaging state between said first engaging portion of said first and said second cylindrical portions and said second engaging portion of said first and said second fixing members is ensured by a restoring force of said elastically deformed first and second elastic bodies.

25. A production process of an ink tank, comprising the steps of:

inserting a dome-shaped elastic body into a cylindrical portion provided in an ink container for storing ink, said cylindrical portion having a first engaging portion and an opening portion, said elastic body having an external cylindrical diameter substantially equal to an internal diameter of said cylindrical portion;

compressing said elastic body; and fixing said elastic body in said cylindrical portion by a fixing member having a second engaging portion for engaging said first engaging portion of said cylindrical portion and having an opening portion for passing said needle body, and adapted for directly clamping and pushing said elastic body in collaboration with said cylindrical portion to close said opening portion of said cylindrical portion. said fixing member compression-attaching said elastic bodv to said cylindrical Portion, and wherein an engaging state between said first engaging portion of said cylindrical portion and said second engaging portion of said fixing member is ensured by a restoring force of said elastically deformed elastic body.

26. A production process of an ink tank, comprising the steps of:

inserting a dome-shaped elastic body into a cylindrical portion provided in a waste ink container for storing ink used in a printing apparatus, said cylindrical portion having a first engaging portion and an opening portion, said elastic body having an external cylindrical diameter substantially equal to an internal diameter of said cylindrical portion;

compressing said elastic body; and fixing said elastic body in said cylindrical portion by a fixing member having a second engaging portion for engaging said first engaging portion of said cylindrical portion and an opening portion for passing a needle body, and adapted for directly clamping and pushing said elastic body in collaboration with said cylindrical portion to close said opening portion of said cylindrical portion, said fixing member compression-attaching said elastic body to said cylindrical portion, whereby an engaging state between said first engaging portion of said cylindrical portion and said second engaging portion of said fixing member is ensured by a restoring force of said elastically deformed elastic body.

27. A production process of an ink tank, comprising the steps of:

providing a coupled body comprising an ink container storing ink to be used in a printing apparatus, said ink container having a first cylindrical portion having a first engaging portion and an opening portion for delivering the ink to said printing apparatus, and a waste ink container storing waste ink used by said printing apparatus, said waste ink container having a second cylindrical portion having a first engaging portion and an opening portion for introducing the waste ink into said waste ink container;

inserting a dome-shaped first elastic body having an external cylindrical diameter substantially equal to an internal diameter of said first cylindrical portion into said first cylindrical portion;

inserting a dome-shaped second elastic body having an external cylindrical diameter substantially equal to an internal diameter of said second cylindrical portion into said second cylindrical portion;

compressing said first elastic body and said second elastic body; and fixing said first elastic body and said second elastic body in said first and said second cylindrical portions, respectively, so that a first and a second fixing means each having a second engaging portion for engaging said first engaging Portion of said first and said second cylindrical portions directly clamps and pushes said first and second elastic bodies in collaboration with said first and said second cylindrical portions to close said first and said second opening portions of said first and said second cylindrical portions, said first and said second fixing means compression-attaching said first and said second elastic bodies to said first and said second cylindrical portions, whereby an engaging state between said first engaging portion of said first and said second cylindrical portions and said second engaging portion of said first and said second fixing means is ensured by a restoring force of said elastically deformed first and second elastic bodies.

28. An ink tank comprising:

an ink container for storing an ink employed in a printing apparatus;

a cylindrical portion provided in said ink container for delivering said ink to said printing apparatus;

a dome-shaped elastic body closing said cylindrical portion, said elastic body for having a needle body pierce therethrough for supplying the ink to said printing apparatus;

a fixing member maintaining closure of said cylindrical portion by said elastic body; and a housing portion provided coaxially with said cylindrical portion for receiving said elastic body, said housing portion having an elastic body receptacle portion having an internal diameter greater than an internal diameter of said cylindrical portion and a fixing member engaging portion provided on an outer periphery portion of said housing portion, wherein said fixing member further comprises a pushing portion for depressing a top portion of said elastic body received within said elastic body receptacle portion to compression-attach said elastic body to said elastic body receptacle portion, and a plurality of claw portions for coupling with said fixing member engaging portion, and said fixing member engaging portion is reliably kept in an engagement with said fixing member by a restoring force of said elastic body.

29. An ink tank as claimed in claim 28, wherein said fixing member engaging portion of said housing portion comprises a plurality of grooves guiding said claw portions of said fixing member, wherein each of said grooves comprises a longitudinal first groove portion extending on the outer periphery portion of said housing portion along a longitudinal axis of said cylindrical portion and a second groove portion communicated with said first groove portion extending in a circumferential direction about said longitudinal axis.

30. An ink tank as claimed in claim 29, wherein said second groove portion further comprises an engaging portion engaging with said claw portion of said fixing member.

31. An ink tank as claimed in claim 28, wherein said elastic body is of a dome shaped configuration having an external cylindrical diameter substantially equal to an internal diameter of said elastic body receptacle portion.

32. An ink tank as claimed in claim 28, wherein, in a case that an internal radius of said elastic body receptacle portion is r and a spherical radius of said elastic body in a non-deformed condition is R, $1.05<(R/r)\sin^{-1}(r/R)<1.57$ is satisfied.

33. An ink tank as claimed in claim 28, wherein, in a case that an internal radius of said elastic body receptacle portion is r and a spherical radius of said elastic body in a non-deformed condition is R, $1.1<(R/r)\sin^{-1}(r/R)<1.4$ is satisfied.

34. An ink tank as claimed in claim 28, wherein an ink is filled in said ink container.

35. An ink tank comprising:

a waste ink container for storing an ink used in a printing apparatus;

a cylindrical portion provided in said waste ink container for introducing a waste ink into said waste ink container;

a dome-shaped elastic body closing said cylindrical portion, said elastic body for having a needle body pierce therethrough for introducing the waste ink from said printing apparatus into said waste ink container;

a fixing member maintaining closure of said cylindrical portion by said elastic body; and a housing portion provided coaxially with said cylindrical portion for receiving said elastic body, said housing portion having an elastic body receptacle portion having an internal diameter greater than an internal diameter of said cylindrical portion, and a fixing member engaging portion provided on an outer periphery portion of said housing portion, wherein said fixing member further comprises a pushing portion for depressing a top portion of said elastic body received within said elastic body receptacle portion to compression-attach said elastic body for said elastic body receptacle portion, and a plurality of claw portions for coupling with said fixing member engaging portion, and said fixing member engaging portion is reliably kept in an engagement with said fixing member by a restoring force of said elastic body.

36. A production process of an ink tank, comprising the steps of:

inserting a dome-shaped elastic body within an elastic body receptacle portion of a housing having an internal diameter greater than an internal diameter of a cylindrical portion coaxial with the receptacle portion, the cylindrical portion for delivering ink to a printing apparatus; and fitting a fixing member onto said housing for closing said cylindrical portion by said elastic body, said fixing member comprising a pushing portion depressing said elastic body for compression-attaching said elastic body to within said elastic body receptacle portion, and a plurality of claw portions engaging with engaging portions of said housing, and said fixing member engaging portion is reliably kept in an engagement with said fixing member by a restoring force of said elastic body.

37. A production process of an ink tank, comprising the steps of:

inserting a dome-shaped elastic body within an elastic body receptacle portion of a housing having an internal diameter greater than an internal diameter of a cylindrical portion coaxial with the receptacle portion, the cylindrical hole for introducing a waste ink from a printing apparatus; and fitting a fixing member onto said housing for closing said cylindrical portion by said elastic body, said fixing member comprising a pushing portion depressing said elastic body for compression-attaching said elastic body to within said elastic body receptacle portion, and a plurality of claw portions engaging with engaging portions of said housing, and said fixing member engaging portion is reliably kept in an engagement with said fixing member by a restoring force of said elastic body.

38. An ink tank for storing an ink to be used in a printing apparatus and an ink used in the printing apparatus, comprising:

an ink container storing the ink to be used in said printing apparatus;

a waste ink container storing the ink used in said printing apparatus;

an atmosphere communication hole provided in said waste ink container; and an ink tank coupling member provided on one of or both of said ink container and said waste ink container for coupling said ink container and said waste ink container, said ink tank coupling member forming an ink guide path for guiding ink flowed from said atmosphere communication hole to a predetermined position of said ink container or said waste ink container, wherein a printing apparatus coupling portion is provided on one of or both of said ink container and said waste ink container for coupling said ink container or said waste ink container to a printing apparatus, said printing apparatus coupling portion comprising:

a cylindrical portion;

an elastic body closing said cylindrical portion, said elastic body for piercing by a needle body; and a fixing member for maintaining closure of said cylindrical portion by said elastic body, wherein said elastic body has a dome shaped configuration having a cylindrical diameter substantially equal to an internal diameter of said cylindrical portion.

39. An ink tank as claimed in claim 38, wherein said ink guide path is formed by a guide surface of said ink tank coupling member.

40. An ink tank as claimed in claim 38, wherein said ink tank coupling member has an engaging recess portion, an engaging snap portion engaged with said recessed portion by elastic deformation, and a spring portion biasing said engaging snap portion in a direction for fixing engagement with said recessed portion.

41. An ink tank as claimed in claim 38, wherein an ink is filled in said ink container.

42. An ink tank as claimed in claim 38, further comprising a housing portion coaxial with said cylindrical portion, wherein, in a case that an internal radius of said housing is r and a spherical radius of said elastic body in a non-deformed condition is R, $1.05<(R/r)\sin^{-1}(r/R)<1.57$ is satisfied.

43. An ink tank as claimed in claim 38, further comprising a housing coaxial with said cylindrical portion, wherein, in a case that an internal radius of said housing is r and a spherical radius of said elastic body in a non-deformed condition is R, $1.1<(R/r)\sin^{-1}(r/R)<1.4$ is satisfied.

44. An ink tank as claimed in claim 38, further comprising a housing portion coaxial with said cylindrical portion, the housing portion having an internal diameter greater than said cylindrical portion, and fixing member engaging portions provided on an outer periphery portion of said housing, wherein said elastic body has a cylindrical diameter substantially equal to the internal diameter of said housing portion and is received within said housing portion, and wherein said fixing member has a pushing portion for depressing a top portion of said elastic body received within said housing portion to cause elastic deformation of said elastic body, and a plurality of claw portions for coupling said fixing member with said fixing member engaging portions.

* * * * *

UNITED STATES PATENT AND TRADEMARK OFFICE

CERTIFICATE OF CORRECTION

PATENT NO. : 6,132,036
DATED : October 17, 2000
INVENTOR(S) : Abe et al.

It is certified that error appears in the above-identified patent and that said Letters Patent is hereby corrected as shown below:

Column 1,
Line 35, "layer" should read -- layers --;
Line 36, "ends." should read -- end. --; and
Line 52, "exude" should read -- exuding --;.

Figure 1:
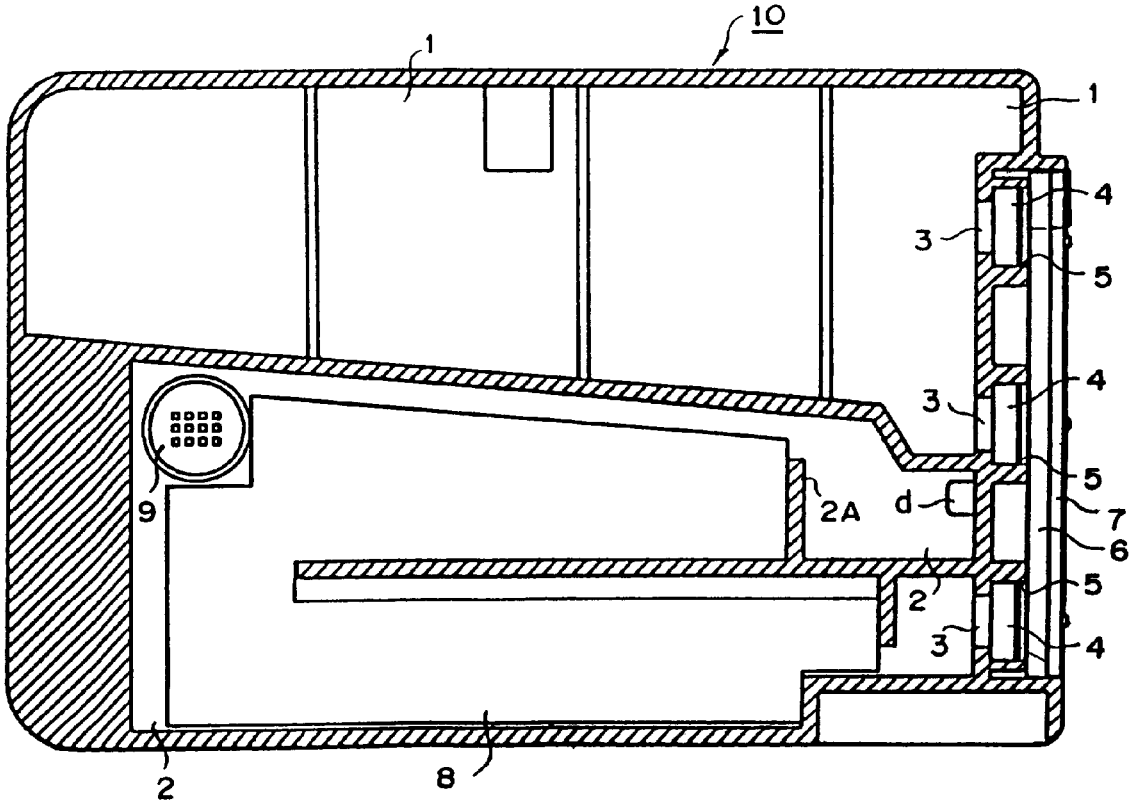
FIG. 1 (PRIOR ART)
FIG. 1 is a section showing one example of the conventional ink tank.
Figure 2:
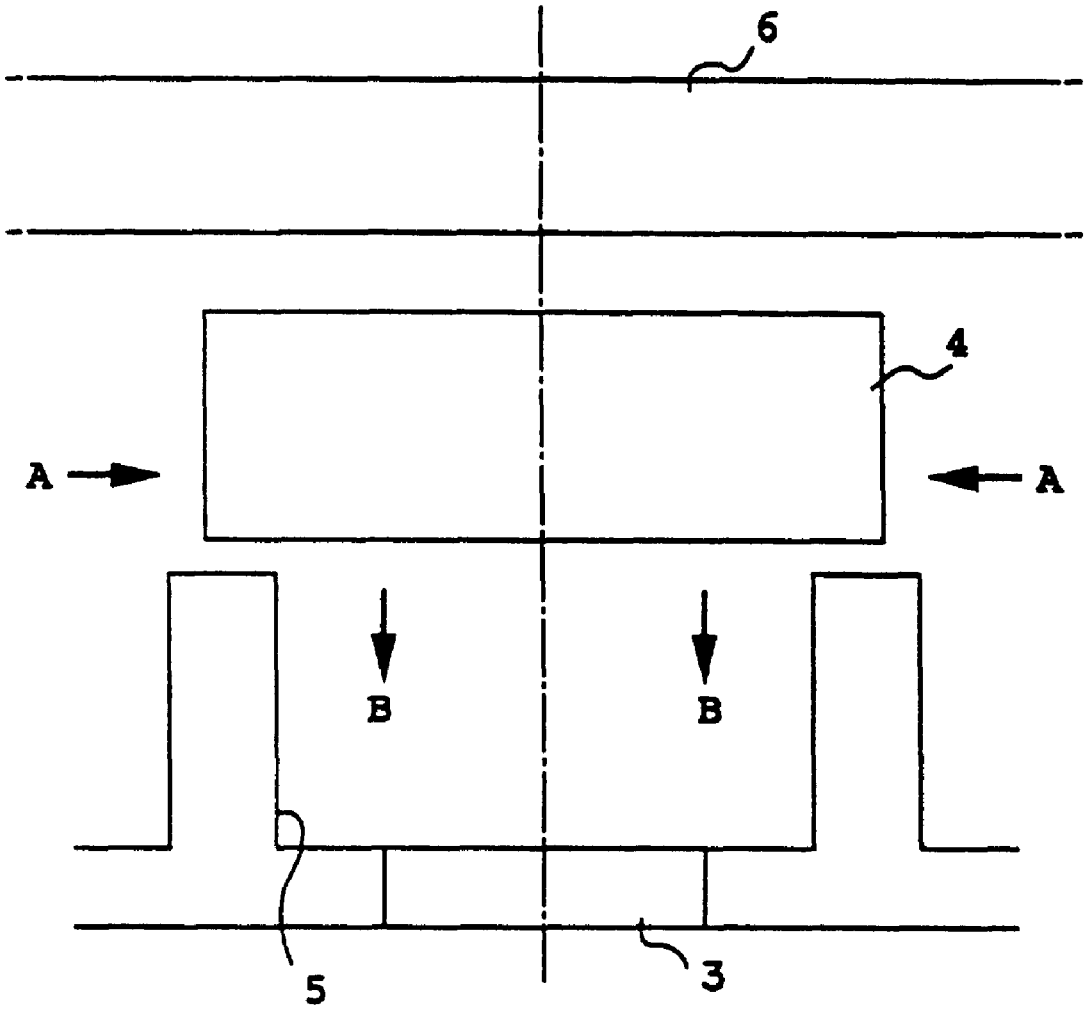
FIG. 2 (PRIOR ART)
FIG. 2 is an enlarged section showing an ink coupling portion of the ink tank of FIG. 1.

Column 2,
Line 10, "Fig, 1" should read -- Fig. 1 --; and
Line 34, "of" should read -- to --.

Column 3,
Line 2, "ability." should read -- ability --; and
Line 45, "on" should read -- on the --.

Column 4,
Line 66, "diameters" should read -- diameter --.

Column 5,
Line 16, "R." should read -- R, --.

Column 6,
Line 10, "hole;" should read -- hole; and --.

Column 8,
Line 63, "fixing-member" should read -- fixing member --.

Column 9,
Line 30, "pf" should read -- of --.

Column 10,
Line 34, "other" should read -- another --;
Line 35, "unnecessary" should read -- unnecessarily --; and
Line 41, "forms" should read -- form --.

UNITED STATES PATENT AND TRADEMARK OFFICE

CERTIFICATE OF CORRECTION

PATENT NO. : 6,132,036
DATED : October 17, 2000
INVENTOR(S) : Abe et al.

It is certified that error appears in the above-identified patent and that said Letters Patent is hereby corrected as shown below:

Column 11,
Line 41, "ius" should read -- is --.

Column 12,
Line 5, "welding-" should read -- welding --;
Line 12, "be-welded" should read -- be welded --;
Line 16, "effect" should read -- effects --;
Line 22, "is" should read -- are --;
Line 23, "is difficulty" should read -- are difficult --;
Line 27, "have" should read -- has --;
Line 56, "that" should be deleted; and
Line 66, "40C" should read -- 40c --.

Column 13,
Line 11, "this." should read -- this, --;
Line 20, "relative" should read -- relatively --; and
Line 52, "section" should read -- sections --.

Column 14,
Line 19, "solidified." should read -- solidified, --;
Line 43, "container" should read -- containers --;
Line 63, "Fig. 1iB)." should read -- Fig. 11B). --; and
Line 64, "Thus." should read -- Thus, --.

Column 15,
Line 13, "adapted" should read -- adapt --; and
Line 37, "be arisen" should read -- arise --.

Column 16,
Line 18, "the." should read -- the --.

Column 17,
Table 1, "1. 1" should read -- 1.1 --.

UNITED STATES PATENT AND TRADEMARK OFFICE

CERTIFICATE OF CORRECTION

PATENT NO. : 6,132,036
DATED : October 17, 2000
INVENTOR(S) : Abe et al.

It is certified that error appears in the above-identified patent and that said Letters Patent is hereby corrected as shown below:

Column 18,
Line 2, "of the" should be deleted;
Line 15, "other to" should be deleted;
Line 36, "a" should read -- at --; and
Line 57, "opened/" should read -- opened. --.

Column 19,
Line 38, "be arisen" should read -- arise --.

Column 20,
Line 24, "is" should read -- are --.

Column 21,
Lines 52 and 54, "slide" should read -- slid --.

Column 22,
Line 34, "14OBk" should read -- 140Bk --; and
Line 62, "filing" should read -- filling --.

Column 23,
Line 12, "invention," should read -- intention, --.

Column 25,
Line 22, "engaginq" should read -- engaging --.

Column 27,
Line 2, "port ion" should read -- portion --; and
Line 25, "bode." should read -- body. --.

Column 28,
Line 31, "Portion," should read -- portion, --.

Column 29,
Line 20, "Portion" should read -- portion --.

UNITED STATES PATENT AND TRADEMARK OFFICE

CERTIFICATE OF CORRECTION

PATENT NO. : 6,132,036
DATED : October 17, 2000
INVENTOR(S) : Abe et al.

It is certified that error appears in the above-identified patent and that said Letters Patent is hereby corrected as shown below:

Column 30,
Line 10, "dome shaped" should read -- dome-shaped --.

Column 32,
Line 3, "dome shaped" should read -- dome-shaped --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*